US009919536B2

(12) United States Patent
Miyashita et al.

(10) Patent No.: US 9,919,536 B2
(45) Date of Patent: Mar. 20, 2018

(54) LIQUID CONTAINER

(71) Applicant: CANON KABUSHIKI KAISHA, Tokyo (JP)

(72) Inventors: Takeho Miyashita, Yokohama (JP); Yasuo Kotaki, Yokohama (JP); Tetsuya Ohashi, Matsudo (JP); Hiroki Hayashi, Kawasaki (JP); Manabu Ohara, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/272,026

(22) Filed: Sep. 21, 2016

(65) Prior Publication Data

US 2017/0087863 A1 Mar. 30, 2017

(30) Foreign Application Priority Data

Sep. 30, 2015 (JP) ..... 2015-194313

(51) Int. Cl.
*B41J 2/175* (2006.01)

(52) U.S. Cl.
CPC ..... *B41J 2/17553* (2013.01); *B41J 2/17509* (2013.01); *B41J 2/17523* (2013.01)

(58) Field of Classification Search
CPC ..... B41J 2/17553
USPC ..... 347/86
See application file for complete search history.

(56) References Cited

U.S. PATENT DOCUMENTS 5,425,478 A 6/1995 Kotaki et al. ..... 222/501
5,430,471 A 7/1995 Nakajima et al. ..... 347/87
5,512,925 A 4/1996 Ohashi ..... 347/86
5,567,373 A 10/1996 Sato et al. ..... 264/112
5,583,549 A 12/1996 Ujita et al. ..... 347/86
5,589,862 A 12/1996 Ujita et al. ..... 347/87
5,608,437 A 3/1997 Iwata et al. ..... 347/86
5,619,237 A 4/1997 Inoue et al. ..... 347/86
5,619,239 A 4/1997 Kotaki et al. ..... 347/86
(Continued)

FOREIGN PATENT DOCUMENTS

JP H11-348308 12/1999
JP 2002-307711 10/2002
JP 2013-123905 6/2013

OTHER PUBLICATIONS

U.S. Appl. No. 15/274,806, filed Sep. 23, 2016.
U.S. Appl. No. 15/288,879, filed Oct. 7, 2016.

*Primary Examiner* — Huan Tran
*Assistant Examiner* — Alexander D Shenderov
(74) *Attorney, Agent, or Firm* — Fitzpatrick, Cella, Harper & Scinto

(57) ABSTRACT

A liquid container is enabled to contain a liquid therein. An outer wall of the liquid container has a first surface, a second and a third surfaces are adjacent to the first surface, and the second surface and the third surface face each other. The first surface has a space in which a storage element storing the information on the liquid container is contained. The first surface and the second surface have a first recessed portion that crosses a boundary between the first surface and the second surface, and the first surface and the third surface have a second recessed portion that crosses a boundary between the first surface and the third surface. The first recessed portion and the second recessed portion face each other across the space.

9 Claims, 24 Drawing Sheets

(56) References Cited

U.S. PATENT DOCUMENTS

| | | | | |
|---|---|---|---|---|
| 5,742,310 | A | 4/1998 | Kotaki | 347/86 |
| 5,781,213 | A | 7/1998 | Ujita et al. | 347/86 |
| 5,805,188 | A | 9/1998 | Nakajima et al. | 347/87 |
| 5,815,184 | A | 9/1998 | Ujita et al. | 347/87 |
| 5,852,457 | A | 12/1998 | Kotaki et al. | 347/86 |
| 5,896,152 | A | 4/1999 | Ohashi | 347/86 |
| 5,929,885 | A | 7/1999 | Nakajima et al. | 347/87 |
| 5,988,804 | A | 11/1999 | Kotaki et al. | 347/87 |
| 6,070,974 | A | 6/2000 | Kotaki et al. | 347/86 |
| 6,116,722 | A | 9/2000 | Sato et al. | 347/85 |
| 6,130,695 | A | 10/2000 | Childers et al. | 347/85 |
| 6,145,975 | A | 11/2000 | Kotaki et al. | 347/87 |
| 6,170,939 | B1 | 1/2001 | Ujita et al. | 347/86 |
| 6,243,116 | B1 | 6/2001 | Kotaki et al. | 347/86 |
| 6,270,206 | B1 | 8/2001 | Shimizu et al. | 347/86 |
| 6,325,500 | B1 | 12/2001 | Kitabatake et al. | 347/86 |
| 6,336,709 | B1 | 1/2002 | Inoue et al. | 347/49 |
| 6,338,546 | B1 | 1/2002 | Kotaki et al. | 347/49 |
| 6,347,865 | B1 | 2/2002 | Matsumoto et al. | 347/86 |
| 6,361,158 | B1 | 3/2002 | Inoue et al. | 347/86 |
| 6,382,783 | B1 | 5/2002 | Hayashi et al. | 347/85 |
| 6,390,612 | B1 | 5/2002 | Kotaki et al. | 347/85 |
| 6,402,298 | B1 | 6/2002 | Nanjo et al. | 347/49 |
| 6,419,350 | B1 | 7/2002 | Abe et al. | 347/86 |
| 6,421,623 | B1 | 7/2002 | Furukawa et al. | 702/100 |
| 6,422,674 | B1 | 7/2002 | Hinami et al. | 347/7 |
| 6,443,567 | B1 | 9/2002 | Hayashi et al. | 347/85 |
| 6,447,084 | B1 | 9/2002 | Uetsuki et al. | 347/7 |
| 6,450,631 | B1 | 9/2002 | Hayashi et al. | 347/86 |
| 6,471,343 | B1 | 10/2002 | Shimizu et al. | 347/85 |
| 6,474,797 | B2 | 11/2002 | Kurata et al. | 347/85 |
| 6,485,136 | B1 | 11/2002 | Shimizu et al. | 347/86 |
| 6,505,923 | B1 | 1/2003 | Yamamoto et al. | 347/85 |
| 6,511,167 | B1 | 1/2003 | Kitabatake et al. | 347/86 |
| 6,530,654 | B2 | 3/2003 | Kitabatake et al. | 347/86 |
| 6,540,321 | B1 | 4/2003 | Hirano et al. | 347/22 |
| 6,540,342 | B2 | 4/2003 | Koshikawa et al. | 347/86 |
| 6,543,886 | B1 | 4/2003 | Hattori et al. | 347/85 |
| 6,550,898 | B2 | 4/2003 | Hayashi et al. | 347/85 |
| 6,598,963 | B1 | 7/2003 | Yamamoto et al. | 347/85 |
| 6,623,104 | B1 | 9/2003 | Kotaki et al. | 347/49 |
| 6,629,758 | B2 | 10/2003 | Okamoto et al. | 347/85 |
| 6,637,872 | B2 | 10/2003 | Ara et al. | 347/85 |
| 6,692,115 | B2 | 2/2004 | Sanada et al. | 347/85 |
| 6,698,871 | B1 | 3/2004 | Hayashi et al. | 347/86 |
| 6,702,427 | B2 | 3/2004 | Shimizu et al. | B41J 2/17513 |
| 6,709,092 | B2 | 3/2004 | Hayashi et al. | 347/86 |
| 6,719,415 | B1 | 4/2004 | Hattori et al. | 347/86 |
| 6,719,416 | B2 | 4/2004 | Anma et al. | 347/86 |
| 6,742,881 | B2 | 6/2004 | Kotaki et al. | 347/86 |
| 6,746,110 | B2 | 6/2004 | Hayashi | 347/86 |
| 6,755,500 | B2 | 6/2004 | Hirano et al. | 347/22 |
| 6,773,099 | B2 | 8/2004 | Inoue et al. | 347/86 |
| 6,796,645 | B2 | 9/2004 | Hayashi et al. | 347/86 |
| 6,805,434 | B2 | 10/2004 | Hayashi et al. | 347/85 |
| 6,815,381 | B1 | 11/2004 | Yamamoto et al. | 442/187 |
| 6,827,431 | B2 | 12/2004 | Kitabatake et al. | 347/86 |
| 6,830,324 | B2 | 12/2004 | Ogura et al. | 347/86 |
| 6,851,798 | B2 | 2/2005 | Koshikawa et al. | 347/85 |
| 6,854,836 | B2 | 2/2005 | Ishinaga et al. | 347/85 |
| 6,863,762 | B2 | 3/2005 | Sanada et al. | 156/180 |
| 6,869,158 | B2 | 3/2005 | Kojima et al. | 347/19 |
| 6,877,847 | B2 | 4/2005 | Hayashi et al. | 347/86 |
| 6,916,085 | B2 | 7/2005 | Kotaki et al. | 347/49 |
| 6,935,739 | B2 | 8/2005 | Inoue et al. | 347/104 |
| 6,942,326 | B2 | 9/2005 | Hayashi et al. | 347/86 |
| 6,959,984 | B2 | 11/2005 | Ogura et al. | 347/86 |
| 6,966,631 | B2 | 11/2005 | Matsuo et al. | 347/49 |
| 6,969,161 | B2 | 11/2005 | Kuwabara et al. | 347/85 |
| 6,976,753 | B2 | 12/2005 | Kuwabara et al. | 347/86 |
| 6,997,548 | B2 | 2/2006 | Matsuo et al. | 347/86 |
| 7,004,575 | B2 | 2/2006 | Inoue et al. | 347/86 |
| 7,086,725 | B2 | 8/2006 | Ogura et al. | 347/86 |
| 7,111,931 | B2 | 9/2006 | Amma et al. | 347/86 |
| 7,118,194 | B2 | 10/2006 | Matsuo et al. | 347/49 |
| 7,125,109 | B2 | 10/2006 | Watanabe et al. | 347/86 |
| 7,134,747 | B2 | 11/2006 | Hayashi et al. | 347/86 |
| 7,165,829 | B2 | 1/2007 | Hayashi et al. | 347/49 |
| 7,350,910 | B2 | 4/2008 | Amma et al. | 347/86 |
| 7,360,876 | B2 | 4/2008 | Inoue et al. | 347/85 |
| 7,384,116 | B2 | 6/2008 | Kotaki et al. | 347/19 |
| 7,396,118 | B2 | 7/2008 | Ogawa et al. | 347/87 |
| 7,401,909 | B2 | 7/2008 | Inoue et al. | 347/86 |
| 7,407,274 | B2 | 8/2008 | Inoue et al. | 347/86 |
| 7,407,275 | B2 | 8/2008 | Inoue et al. | 347/86 |
| 7,607,770 | B2 | 10/2009 | Inoue et al. | 347/85 |
| 7,735,984 | B2 | 6/2010 | Iijima et al. | 347/86 |
| 7,914,137 | B2 | 3/2011 | Inoue et al. | 347/86 |
| 7,926,927 | B2 | 4/2011 | Kotaki et al. | 347/86 |
| 7,950,790 | B2 | 5/2011 | Kubo et al. | 347/86 |
| 8,011,768 | B2 | 9/2011 | Hayashi et al. | 347/86 |
| 8,020,978 | B2 | 9/2011 | Ogawa et al. | 347/86 |
| 8,047,641 | B2 | 11/2011 | Nanjo et al. | 347/86 |
| 8,109,617 | B2 | 2/2012 | Kotaki et al. | 347/86 |
| 8,136,930 | B2 | 3/2012 | Anma et al. | 347/86 |
| 8,205,974 | B2 | 6/2012 | Ogura et al. | 347/86 |
| 8,313,185 | B2 | 11/2012 | Hatasa et al. | 347/92 |
| 8,322,807 | B2 | 12/2012 | Seki et al. | 347/6 |
| 8,425,022 | B2 | 4/2013 | Inoue et al. | 347/86 |
| 8,439,491 | B2 | 5/2013 | Hayashi et al. | 347/86 |
| 8,469,498 | B2 | 6/2013 | Ohashi et al. | 347/86 |
| 8,485,642 | B2 | 7/2013 | Hayashi et al. | 347/49 |
| 8,529,037 | B2 | 9/2013 | Miyashita et al. | 347/86 |
| 8,550,607 | B2 | 10/2013 | Inoue et al. | 347/86 |
| 8,770,730 | B2 | 7/2014 | Nanjo et al. | 347/86 |
| 8,770,731 | B2 | 7/2014 | Miyashita et al. | 347/86 |
| 8,960,869 | B2 | 2/2015 | Takada et al. | 347/86 |
| 9,016,842 | B2 | 4/2015 | Miyashita et al. | 347/86 |
| 9,333,758 | B2 | 5/2016 | Koshikawa et al. | B41J 2/17556 |
| 9,375,938 | B2 | 6/2016 | Kondo et al. | B41J 2/17513 |
| 2002/0109761 | A1* | 8/2002 | Shimizu | B41J 2/17513 347/86 |
| 2003/0038867 | A1 | 2/2003 | Yamamoto et al. | 347/86 |
| 2004/0246304 | A1 | 12/2004 | Takahashi et al. | 347/49 |
| 2005/0007420 | A1 | 1/2005 | Ogawa et al. | 347/50 |
| 2007/0222835 | A1* | 9/2007 | Lui | B41J 2/17513 347/86 |
| 2013/0050310 | A1 | 2/2013 | Seki et al. | 347/6 |
| 2015/0343793 | A1 | 12/2015 | Takada et al. | B41J 2/17556 |
| 2016/0200113 | A1 | 7/2016 | Nanjo et al. | B41J 2/175 |
| 2016/0200114 | A1 | 7/2016 | Nanjo et al. | B41J 2/17553 |

* cited by examiner

LIQUID CONTAINER

BACKGROUND OF THE INVENTION

Field of the Invention

The present invention relates to a liquid container.

Description of the Related Art

Some liquid containers used for liquid ejection apparatuses are configured to be able to be installed in and removed from the liquid ejection apparatus. For a liquid ejection apparatus in which a liquid container is configured to be able to be installed in and removed from the liquid ejection apparatus, when performing an operation of installing or removing the liquid container, a user may drop the liquid container. In that case, the liquid container is subjected to impact.

A certain area of the liquid container may fail to tolerate high impact. For example, to the liquid container, an information storage element may be attached in which information on the liquid container is stored and which exchanges the Information with a liquid ejection apparatus main body. When such an Information storage element is subjected to impact, the accuracy of information commission may be affected.

Japanese Patent Laid-Open No. 2002-307711 discloses a liquid container to which an information storage element is attached. The liquid container disclosed in Japanese Patent Laid-Open No. 2002-307711 is provided with a slit around a portion to which the information storage element is attached, to form an easily deformable area. The area is elastically deformed to absorb unexpected impact.

SUMMARY OF THE INVENTION

An aspect of the present invention provides a liquid container in which a liquid is enabled to be contained. An outer wall of the liquid container has a first surface, a second surface and a third surface are adjacent to the first surface, and the second surface and the third surface face each other. The first surface has a space in which a storage element storing the information on the liquid container is contained. The first surface and the second surface have a first recessed portion that crosses a boundary between the first surface and the second surface. The first surface and the third surface have a second recessed portion that crosses a boundary between the first surface and the third surface. The first recessed portion and the second recessed portion face each other across the space.

Further features of the present invention will become apparent from the following description of exemplary embodiments (with reference to the attached drawings).

DESCRIPTION OF THE EMBODIMENTS

In the liquid container disclosed in Japanese Patent Laid-Open No. 2002-307711, impact that is too high to be absorbed by elastic deformation of an easily deformable area may act on the liquid container. In such a configuration as described in Japanese Patent Laid-Open No. 2002-307711, impact may act on an area of the liquid container to which the information storage element is attached, to deform the information storage element and electric connection portions. Thus, the accuracy of information communication may be affected.

A liquid container according to an embodiment of the present invention will be described below with reference to the drawings. First, a configuration of a liquid ejection apparatus will be described in which the liquid container according to an embodiment of the present invention is installed. The liquid container may be an ink tank. The liquid ejection apparatus may be an ink jet printing apparatus.

Figure 1:
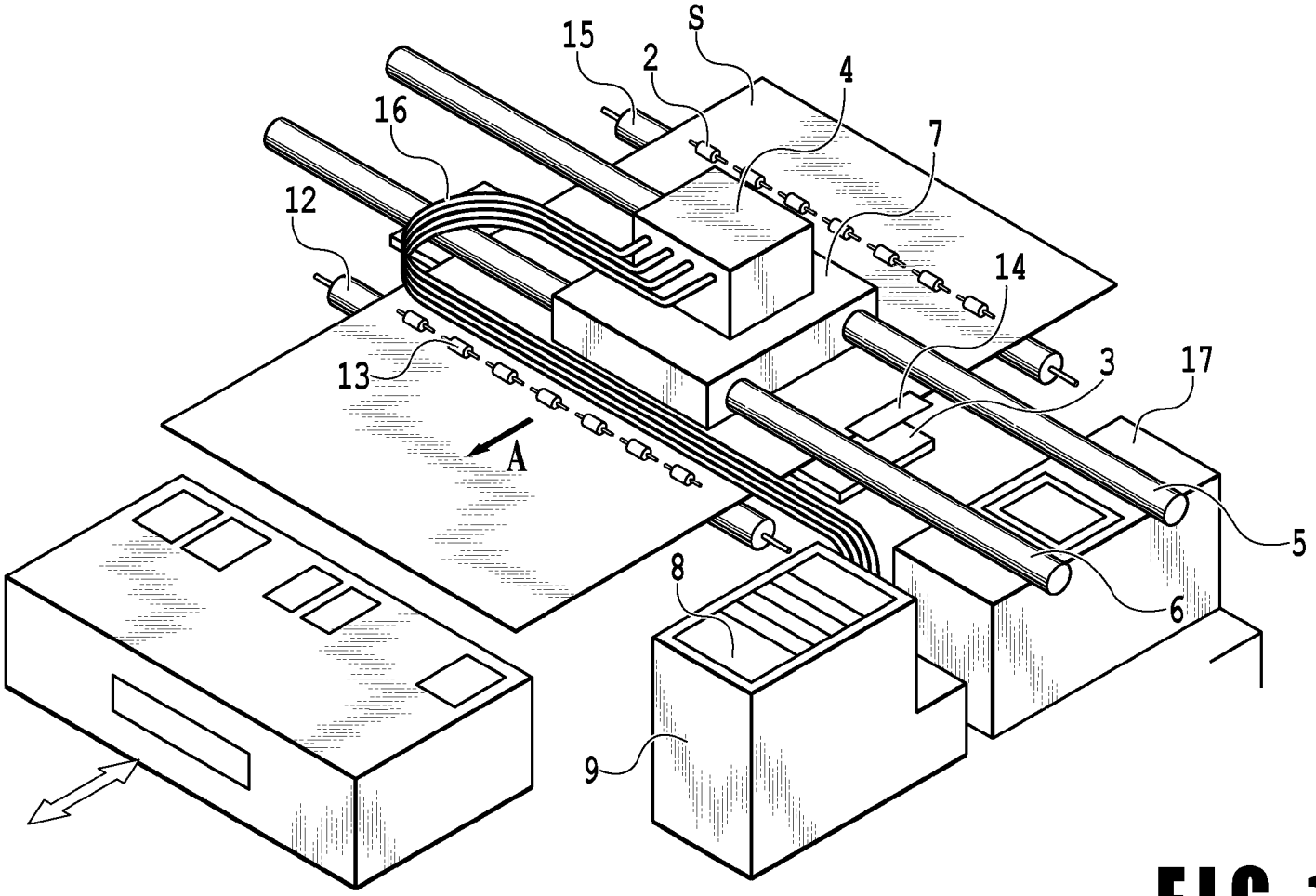
FIG. 1 is a perspective view of a liquid ejection apparatus with a liquid container installed therein.

As depicted in FIG. 1, a liquid ejection apparatus 100 includes conveying unit for conveying print media S that are print sheets such as print paper or plastic sheets. The print media S are conveyed in the direction of arrow A in FIG. 1 by the conveying unit. The liquid ejection apparatus 100 includes, as the conveying unit, a conveying roller 15 and a pinch roller 2 that rotates in conjunction with the conveying roller 15. A plurality of the pinch rollers 2 is rotatably held by a pinch roller holder not depicted in the drawings. During conveyance, the print medium S is sandwiched between the conveying roller 15 and the pinch roller 2. In this state, the conveying roller 15 is driven and rotated to convey the print medium S onto a platen 3 while guiding and supporting the print medium S.

The liquid ejection apparatus 100 has a print head 4 serving as printing unit capable of ejecting droplets. In the liquid ejection apparatus 100, the print head 4 is removably installed on a carriage 7 so as to be oriented to be able to eject a liquid toward the print medium S. The carriage 7 is driven to reciprocate in a direction (main scanning direction) crossing a conveying direction of the print medium (a direction of arrow A, a sub-scanning direction). As described above, in the present embodiment, the printing apparatus is what is called serial scan liquid ejection apparatus 100 in which the print head 4 installed on the carriage 7 performs printing while moving in the main scanning direction crossing the conveying direction of the print medium S.

The liquid ejection apparatus 100 is provided with a platen 3 at a position opposed to the print head 4. The platen 3 supports the print medium S when an image is formed on the print medium S by ejection of ink droplets from the print head 4. On the platen 3, a presser member 14 is provided which restrains an end of the print medium S from being curled back in a direction crossing the conveying direction (arrow A). The platen 3 and the presser member 14 keep a distance between an ejection port forming surface (a surface on which ejection ports are arranged) of the print head 4 and an opposite surface of the print medium S at a predetermined value. The carriage 7 with the print head 4 installed thereon is guided and supported so as to be able to reciprocate along two guide rails 5 and 6.

The print head 4 disclosed herein uses thermal energy for liquid ejection. The print head 4 includes heating elements (electrothermal transducing elements). A current is conducted through the heating elements to allow the heating elements to generate heat, which heats the liquid around the heating elements. As a result, film boiling occurs to generate bubbles. Resultant bubbling energy causes droplets to be ejected through the ejection ports. In the present embodiment, the heating elements using thermal energy are described as print elements used for liquid ejection. However, the present invention is not limited to this. The print head may be based on, besides the above-described scheme, for example, a scheme using piezo elements that are deformed when a current is conducted through the elements so that the piezo elements are deformed according to the current conduction to push and eject the liquid in the print head through the ejection ports. Any other ejection method may be used so long as droplets can be ejected through the ejection ports.

A plurality of chips is formed in the print head 4, and on the respective chips, ejection port rows through which liquids (ink) in different colors are ejected are provided. In the present embodiment, a plurality of the chips is provided in the print head 4 so as to enable liquids in a plurality of colors to be ejected. The ejection port row formed on each chip is configured to have a plurality of ejection ports with a predetermined pitch. In the liquid ejection apparatus 100 in the present embodiment, a plurality of independent liquid containers (liquid containers) 1 corresponding to the colors of liquids used for the print head 4 is removably installed in a tank installation unit 9. The liquid containers 1 arranged inside the tank installation unit 9 are connected, for the corresponding colors of the liquids in the print head 4, to the respective chips for the corresponding colors via supply tubes 16. A plurality of the supply tubes 16 is provided in association with the respective colors of the liquids so as to allow the liquids to be supplied to the respective chips corresponding to the colors. The inks in the different colors contained in the liquid containers 1 installed in the tank installation unit 9 are independently supplied to the respective chips in the print head 4 and temporarily reserved in liquid chambers in the print head 4.

After an image is formed on the print medium S conveyed onto the platen 3, a discharge roller 12 rotates with the print medium S sandwiched between the discharge roller 12 and a spur 13 that rotates in conjunction with rotation of the discharge roller 12, to discharge the print medium S from the liquid ejection apparatus 100.

A recovery unit 17 serving as a suction recovery apparatus is disposed within a range of reciprocation of the print head 4 in the main scanning direction at a predetermined position in an area outside a range of conveyance of the print medium S (for example, a home position). The recovery unit 17 performs, through suction recovery, discharge not involved in printing with the ink from the print head 4. The recovery unit 17 includes wiper unit that is a flexible blade or the like that is not depicted in the drawings and that allows removal of stains on the ejection port formation surface of the print head 4.

First Embodiment

Figure 2A:
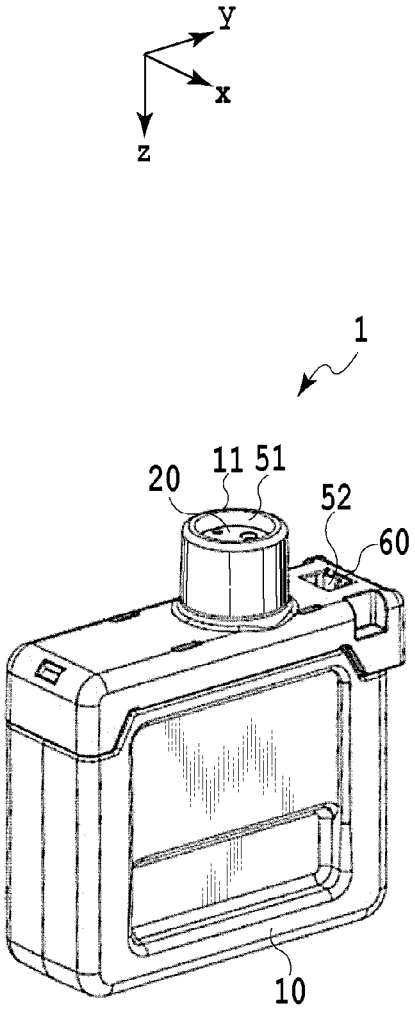
FIG. 2A is a perspective view of the liquid container installed in the liquid ejection apparatus in FIG. 1.
Figure 2B:
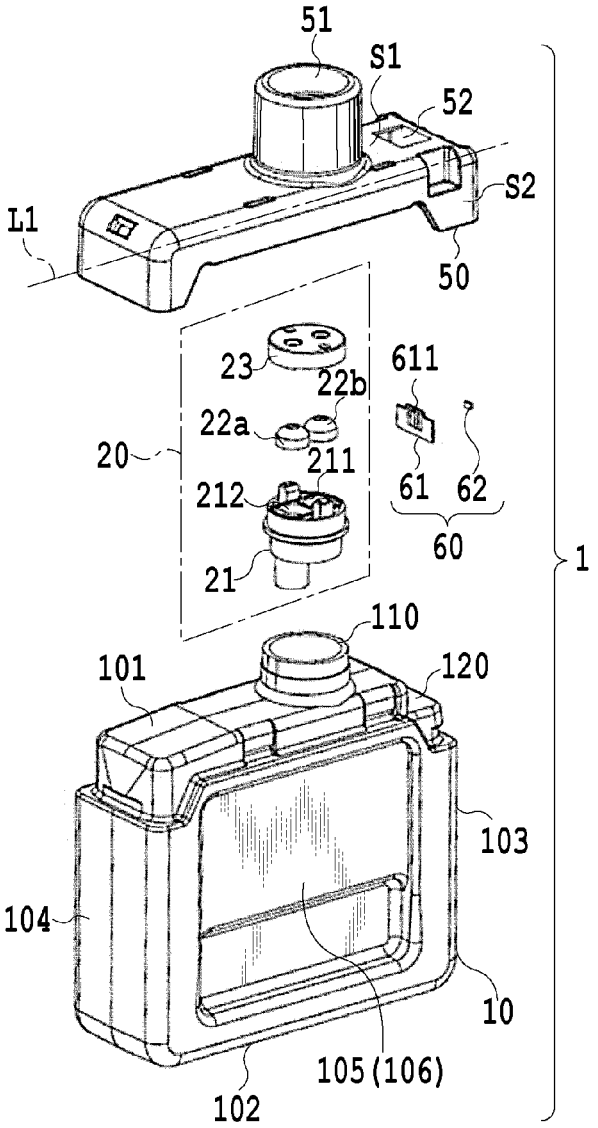
FIG. 2B is an exploded perspective view depicting the configuration of the liquid container that has been disassembled.

Now, a configuration of a liquid container used in a liquid ejection apparatus in the present embodiment will be described. FIG. 2A depicts a perspective view of the liquid container 1 according to the embodiment, and FIG. 2B depicts an exploded perspective view of the liquid container 1.

The liquid container 1 includes a case 10 that contains a liquid such as ink, a joint unit 20 connected to the liquid ejection apparatus 100, and a cover 50 that protects the case 10 and the joint unit 20.

The case 10 is a container in which the liquid can be directly contained. In the case, in a liquid reservoir portion formed inside the container, an opening 110 is formed through which the liquid is externally supplied or discharged to the exterior. The case 10 includes an opening surface 101 in which the opening 110 is formed, a top surface 102 facing the opening surface 101, and side surfaces 103, 104, 105, and 106 formed between the opening surface 101 and the top surface 102. The opening 110 protrudes from the opening surface 101. The opening surface 101, the top surface 102, and the side surfaces 103, 104, 105, and 106 enclose the reservoir portion to function as a container. As described above, the liquid container 1 is configured by assembling the case 10 and the cover 50 together and includes outer walls that enable the liquid to be contained in the liquid container 1 when the liquid container 1 is assembled. The liquid container 1 is configured to be able to contain the liquid inside the container enclosed by the outer walls.

As described above, the liquid container 1 includes the cover 50. The cover 50 is attached to the liquid container 1 so as to cover the surface of the case 10 on which the opening 110 is formed. The cover 50 is provided with a space (storage element containing area) 52 in which a storage element unit 60 is contained. The storage element unit 60 is assembled directly to the cover 50 in the storage element containing area 52. Examples of a method for assembling the storage element unit 60 to the cover 50 include double sided tape, hot melt, and fixture with clinching.

The storage element containing area 52 is open toward the liquid ejection apparatus (in a Z direction in FIGS. 2A and 2B). The storage element containing area 52 is configured such that, into the storage element containing area 52, a liquid ejection apparatus-side connector can be inserted which is described below and which allows the storage element unit 60 and the liquid ejection apparatus to be electrically connected together.

In the storage element containing area 52, a contact portion 611 of a circuit board 61 is fixed so as to face a liquid supply portion 11. That is, a gap is formed between the contact portion 611 and the liquid supply portion 11 to allow the liquid ejection apparatus-side connector to enter the gap. Thus, even when a liquid drops from the liquid supply portion 11 of the liquid container 1, the liquid is trapped in the gap and restrained from adhering to the contact portion 611.

The cover 50 is provided with a connection port 51 at a position corresponding to the opening 110 of the case and the joint unit 20. Thus, the liquid supply portion 11 of the liquid container 1 is formed by assembling the cover 50 to the case 10. When the liquid container 1 is installed in the liquid ejection apparatus 100, the liquid ejection apparatus 100 and the interior of the liquid container 1 are connected together via the liquid supply portion 11.

The joint unit 20 is arranged between the case 10 and the cover 50. The cover 50 is connected to the case 10 with the joint unit 20 sandwiched between the case 10 and the cover 50 such that the cover 50 covers the joint unit 20. Therefore, the liquid reservoir portion inside the case 10 and the connection port 51 in the cover 50 are connected together via the joint unit 20. The joint unit 20 is welded to the opening 110 of the case 10 by hot plate welding or the like.

The joint unit 20 includes a joint member 21, elastic members 22*a* and 22*b*, and a fixing member 23. In the joint member 21, two channels are formed which extend from a liquid outlet port 211 and an air inlet port 212, respectively, penetrating the joint member 21 to communicate with the inside of the case 10. Inside the joint member 21, a liquid channel is formed so as to extend from the liquid outlet port 211 to the opening 110 in the case 10. An air channel is similarly formed so as to extend from the air inlet port 212 to the opening 110. Therefore, the liquid outlet port 211 and the air inlet port 212 function as supply ports for a liquid channel and an air channel, respectively, formed in the joint member 21.

The elastic member 22*b* and the elastic member 22*a* are compressively inserted into the liquid outlet port 211 and the air inlet port 212, respectively. With the elastic members 22*a* and 22*b* inserted into the air inlet port 212 and the liquid outlet port 211, respectively, the fixing member 23 is attached to the joint member 21 from above. In the fixing member 23, a liquid channel and an air channel are formed at positions corresponding to the respective supply ports so as to penetrate the fixing member 23. Ultrasonic welding is externally performed on the fixing member 23 in abutting contact with the elastic members 22*a* and 22*b* to weld the fixing member 23 and the elastic members 22*a* and 22*b* together.

With the elastic members 22*a* and 22*b* arranged between the liquid and air channels formed inside the joint member 21 and the liquid and air channels formed inside the fixing member 23, the joint member 21 and the fixing member 23 are connected together. Consequently, with the elastic members 22*a* and 22*b* arranged in the middle of the liquid and air channels, a liquid channel and an air channel are defined so as to allow the liquid and air channels formed in the joint member 21 to communicate with the liquid and air channels, respectively, formed in the fixing member 23. The joint unit 20 is configured as described above, the elastic members 22*a* and 22*b* are compressively fixed in the respective channels. The channels are sealed with the elastic members 22*a* and 22*b* so as to make the interior of the channels air tight.

While the liquid container 1 is not installed in the liquid ejection apparatus 100, the liquid channel and the air channel are sealed with the elastic members 22*a* and 22*b* to keep the inside of the case 10 air tight. On the main body of the liquid ejection apparatus, a liquid supply needle and an air inlet needle (neither thereof are depicted in the drawings) are provided at positions located opposite to the connection port 51 of the cover 50 of the liquid container 1 when the liquid container 1 is installed in the liquid ejection apparatus. Therefore, when the liquid container 1 is installed in the liquid ejection apparatus, the liquid supply needle and the air inlet needle attached to the liquid ejection apparatus penetrate the elastic members 22*a* and 22*b*. Consequently, the interior of the liquid container 1 and the liquid ejection apparatus are connected together.

Before the liquid container 1 is installed in the liquid ejection apparatus, an area between the case 10 and the cover 50 of the liquid container 1 is sealed with the elastic members 22*a* and 22*b*. The elastic members 22*a* and 22*b* are penetrated by the liquid supply needle and the air inlet needle for the first time when the liquid container 1 is installed in the liquid ejection apparatus. Then, the liquid and air channels in the liquid container 1 are allowed to communicate with the liquid and air channels in the liquid ejection apparatus. Thus, the elastic members 22*a* and 22*b* reliably seal the liquid and air channels until the liquid container 1 is installed in the liquid ejection apparatus, and the liquid inside the liquid reservoir portion is sufficiently held. The liquid reservoir portion is also kept air tight. Therefore, ink leakage from the liquid container 1 can be suppressed while the liquid ejection apparatus is on the market. Examples of a material forming the elastic members 22*a* and 22*b* include flexible materials including a rubber material such as butyl rubber and a thermoplastic resin material such as an elastomer.

The above-described present embodiment has the seal configuration in which the elastic members 22*a* and 22*b* are compressively fixed. However, the present invention is not limited to such a configuration. For example, a configuration may be used in which a valve member is biased toward seal rubber by a spring to seal the opening. Any other configuration may be used so long as the opening in the liquid container is sufficiently sealed while the liquid container is not installed in the liquid ejection apparatus, and is opened when the liquid container is installed in the liquid ejection apparatus. The liquid ejection apparatus may have a uniaxial two-channel needle in which a supply port and an air communication port are integrally formed, and the liquid ejection apparatus may correspondingly have a single supply port.

The liquid container 1 has the storage element unit 60. The storage element unit 60 includes a storage element 62. The storage element 62 stores information on the liquid container (for example, information on the color of the liquid and information specific to the liquid container) and can exchange information with the liquid ejection apparatus 100 while the liquid container 1 is installed in the liquid ejection apparatus. Information exchanged between the liquid ejection apparatus 100 and the liquid container 1 includes the amount of the liquid, the color of the liquid, and whether the liquid container is correctly positioned. In many cases, when the liquid is exhausted, the user replaces the liquid container. Thus, the liquid container preferably includes an arrangement that notifies the user of the remaining amount of the liquid. If the liquid container 1 not correctly positioned, the user is preferably notified of this in order to be urged to place the liquid container 1 at an appropriate position. As unit for transmitting information between the liquid container 1 and the main body of the liquid ejection apparatus 100, the storage element 62 is provided in the liquid container 1.

The storage element 62 is arranged in contact with the circuit board 61. The circuit board 61 includes the contact portion 611, which comes into contact with a contact portion provided in a connector fixed to the liquid ejection apparatus and is electrically connected to the contact portion. These components are integrated together to form the storage element unit 60.

The storage element 62 transmits and receives information to and from the liquid ejection apparatus 100 via electric signals and thus needs to be accurately arranged in order to keep signals accurate. Therefore, when the liquid container 1 is subjected to impact, transmitting the impact to the storage element 62 is not preferable. When the storage element unit 60 is deformed by the impact to displace the storage element 62 from a predetermined position thereof, information transmitted to and received from the main body of the liquid ejection apparatus 100 may be less accurate. Thus, the area in which the storage element 62 is contained (storage element containing area 52) tolerates a smaller amount of deformation than the other areas.

Figure 3:
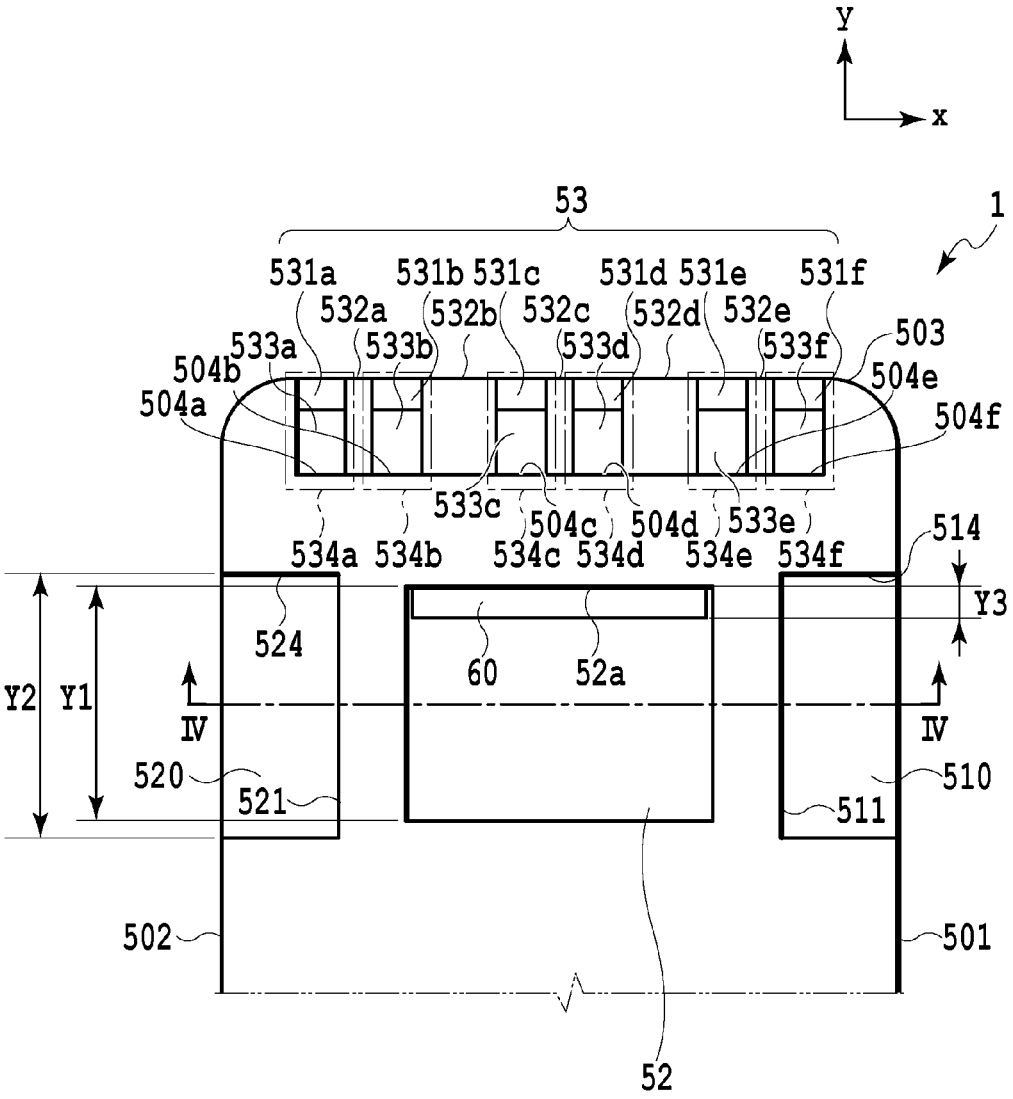
FIG. 3 is a diagram of a part of the liquid container in FIG. 2A as viewed from above.

A configuration of a periphery of the storage element containing area 52 will be described with reference to FIG. 3 and FIG. 4. FIG. 3 is a schematic plan view of a vicinity of the storage element containing area 52 of the cover 50 of the liquid container 1 as viewed from above along the Z direction. FIG. 3 depicts only a part of a side of the cover 50 depicted in FIG. 2A on which the storage element unit 60 (storage element) is arranged.

Figure 4:
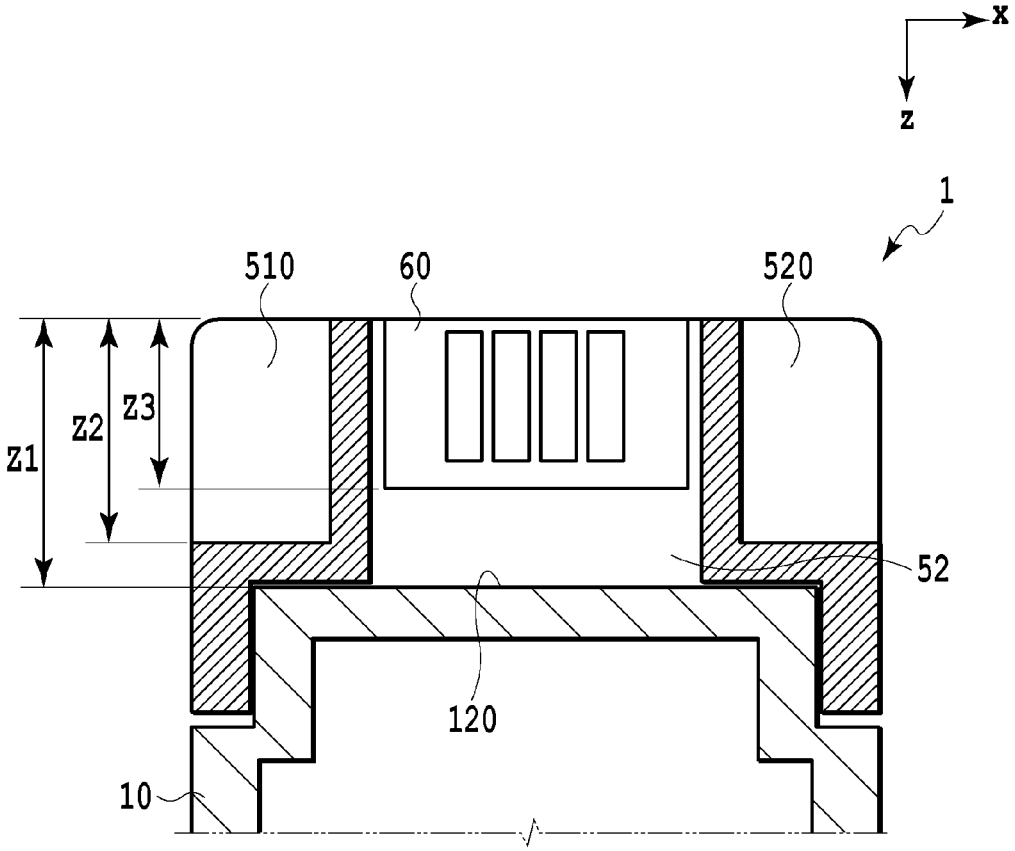
FIG. 4 is a sectional view of the liquid container in FIG. 3 taken along line IV-IV.

FIG. 4 is a schematic sectional view taken along line Iv-Iv in FIG. 3. An end of the side of the cover on which the storage element containing area 52 is formed (the +Y direction side depicted in FIG. 3) is referred to as a cover end surface 503. The cover end surface 503 is provided with identification unit (hereinafter referred to as a mechanical ID) 53. The mechanical ID 53 is provided to allow different types liquid containers to have respective configurations in order to prevent erroneous installation of the liquid container 1. If a particular type of liquid container is installed at an inappropriate position, the mechanical ID 53 and the configuration of the main body of the liquid ejection apparatus 100 interfere with each other to preclude the liquid container 1 from being installed in the main body of the liquid ejection apparatus 100. As described above, any liquid container fails to be arranged at the appropriate position unless the liquid container is arranged at the appropriate position for that type of the liquid container. That is, the mechanical ID 53 functions as identification unit for identifying the type of the liquid container. The mechanical ID 53 include a plurality of protrusions 532*a*, 532*b*, 532*c*, 532*d* and 532*e* and a plurality of beams 531*a*, 531*b*, 531*c*, 531*d*, 531*e*, and 531*f* that connect the protrusions 532*a*, 532*b*, 532*c*, 532*d* and 532*e* together.

The mechanical ID 53 has a shape varying with the type of the liquid container such that each type of liquid container has a corresponding defined shape of the mechanical ID 53. The mechanical ID 53 is formed so as to have a shape defined for each type of liquid container when a part of the mechanical ID 53 configured as described above that is defined for each type of liquid container is removed. Specifically, the beam 531 to be removed is selected for each type of liquid container. On the liquid ejection apparatus, a protrusion is provided at a position corresponding to the removed beam 531. Thus, the shape of the mechanical ID 53 of the liquid container and the shape of the protrusion of the liquid ejection apparatus vary with the type of the liquid container. Each liquid container has an erroneous-installation prevention function.

The beams 531 are formed so as to have clearances 533*a*, 533*b*, 533*c*, 533*d*, 533*e*, and 533*f* with respect to inner side surfaces 504*a*, 504*b*, 504*c*, 504*d*, 504*e*, and 504*f* of cover 50, respectively. Consequently, the mechanical ID 53 include recessed portions 534*a*, 534*b*, 534*c*, 534*d*, 534*e*, and 534*f* having the clearances 533 defined by the beams 531 and the protrusions 532 and the beams and the inner side surfaces 504 of the cover.

As described above, when the liquid container 1 is subjected to impact, transmitting the impact to the storage element 62 is not preferable. Thus, the liquid container 1 in the present invention has the recessed portions at the particular positions on the outer wall. This will be described below.

A surface of the outer wall of the liquid container that is depicted in FIG. 3 is referred to as a first surface. The first surface has a space in which the storage element is contained (storage element containing area 52). A space in which the storage element is contained is provided in a direction perpendicular to the first surface and is open in the first surface. A second surface (a second surface in FIG. 2B) adjacent to the first surface has a first recessed portion 510. The first recessed portion 510 crosses a boundary between the first surface and the second surface and is formed across the first surface and the second surface. On the other hand, a third surface is adjacent to the first surface and faces the second surface. The second recessed portion 520 crosses a boundary between the first surface and the third surface and is formed across the first surface and the third surface. That is, the second surface and the third surface lie opposite to each other and have the first recessed portion 510 and the second recessed portion 520. As also depicted in FIG. 3, the first recessed portion 510 and the second recessed portion 520 are arranged opposite to each other across the space in which the storage element is contained (storage element containing area 52). Since the liquid container 1 in the embodiment of the present invention has the first recessed portion 510 and the second recessed portion 520 as described above, even when the liquid container 1 is subjected to impact, the impact can be restrained from being severely exerted on the space in which the storage element is contained. This allows suppression of deformation of the space in which the storage element is contained and displacement and deformation of the storage element. In particular, since the two recessed portions lie opposite to each other across the space in which the storage element is contained, impact exerted, in various directions, on the space in which the storage element is contained can be suppressed.

The supply port through which the liquid contained inside the liquid container is supplied to the liquid ejection apparatus is located at the position of the connection port 51 in FIGS. 2A and 2B. That is, the supply port is located on the first surface.

The above-described mechanical ID 53 is the third recessed portion. A surface adjacent to the above-described first, second, and third surface is referred to as a fourth surface. The mechanical ID 53 depicted in FIG. 3, that is, the third recessed portion, is located in the first surface and the fourth surface. The third recessed portion crosses a boundary between the first surface and the fourth surface. The third recessed portion also functions as a mechanical ID, and thus, a plurality of third recessed portions is preferably present. FIG. 3 depicts six third recessed portions.

A direction in which the liquid container is installed in the liquid ejection apparatus is referred to as an installation direction. In this case, the second surface and the third surface extend parallel to the installation direction. The fourth surface also extends parallel to the installation direction. When the liquid container is installed in the liquid ejection apparatus, the first surface is oriented to face the liquid container. The first surface extends perpendicularly to the installation direction.

Between the first recessed portion 510 and the second recessed portion 520 and the storage element containing area 52, beams 511 and 521 are provided across the storage element containing area 52. The beams 511 and 521 extend parallel to the second surface 501 and the third surface 502, which are two side surfaces of the cover of the liquid container.

As depicted in FIG. 4, an opening is formed on a −Z direction side of the storage element containing area 52 so that an electric connector of the liquid ejection apparatus can be inserted into the opening. In the present embodiment, a −Z direction-side end surface of the case 10 is formed as a surface 120 corresponding to the storage element containing area 52 of the case 10. However, a +Z direction-side surface of the storage element containing area 52 is not limited to a surface defined by the case 10 as described above. A similar surface may be formed on the cover 50.

In the present embodiment, when the length (height) of the storage element containing area 52 along the Z direction is denoted as Z1, the length of each of the first and second recessed portions 510 and 520 along the Z direction is denoted as Z2, and the length of the storage element unit 60 along the Z direction is denoted as Z3, a relation $Z3<Z2<Z1$ is satisfied. To prevent the storage element unit 60 from being affected by deformation resulting from impact as much as possible, the length of each of the first and second recessed portions 510 and 520 along the Z direction is defined to be larger than the length of the storage element unit 60 along the Z direction. This further restrains the storage element unit 60 from being affected by impact.

Figure 5A:
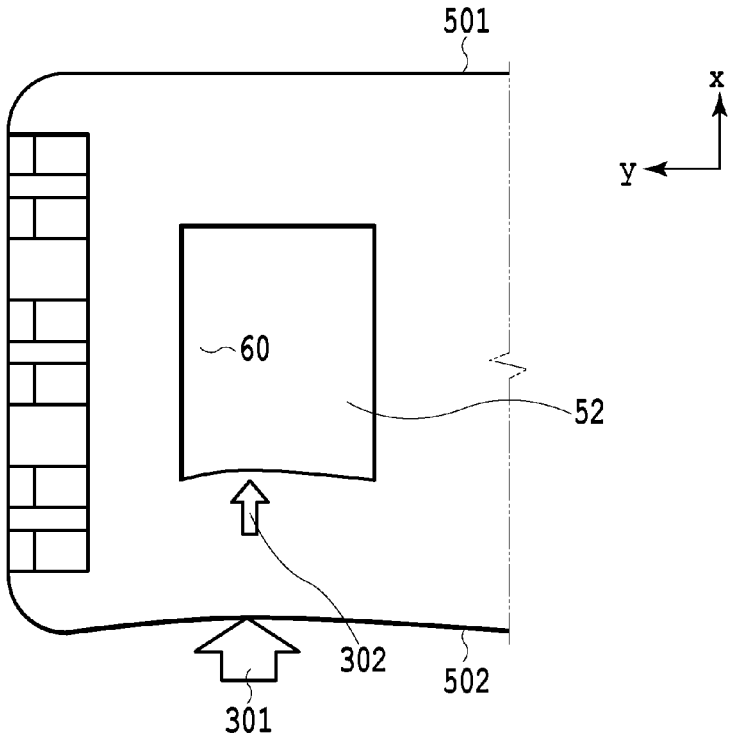
FIG. 5A and FIG. 5B are plan views depicting the state of the liquid container when an external force acts on the liquid container.
Figure 5B:
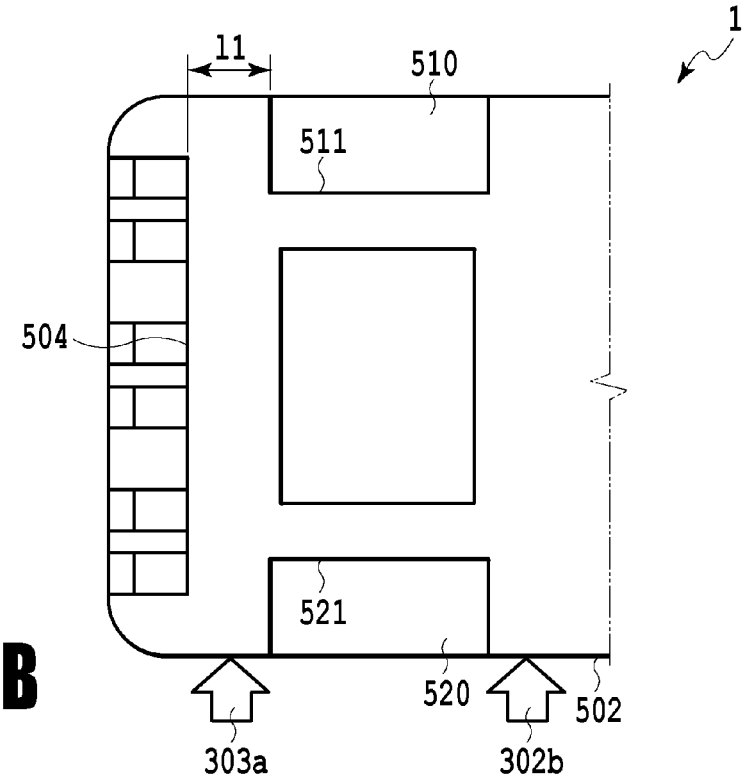

Effects of formation of the first recessed portion 510 and the second recessed portion 520 in the cover 50 will be described below in detail. As described above, transmitting impact to the storage element containing area 52 of the cover 50 is not preferable. However, if the cover 50 is subjected to local impact, for example, when the liquid container 1 is dropped, the vicinity of the storage element containing area 52 in the second surface 501 and the third surface 502 may be subjected to impact as depicted by arrow 301. FIG. 5A depicts the direction in which a force is transmitted when impact is exerted on a side surface of the cover 50 with the first recessed portion 510 and the second recessed portion 520 not formed therein, and also depicts deformation resulting from the transmission of the force. When the cover 50 is not provided with the first recessed portion 510 or the second recessed portion 520, impact is transmitted directly to the storage element containing area 52 as depicted in FIG. 5A. A force resulting from this impact is transmitted as depicted by arrow 302, possibly deforming the storage element containing area 52.

In this regard, in the liquid container 1 in the present embodiment, the first recessed portion 510 and the second recessed portion 520, facing each other across the storage element containing area 52, are formed in the vicinity of the storage element containing area 52 of the cover 50. Since the first recessed portion 510 and the second recessed portion 520 are formed in the cover 50, impact exerted, for example, when the liquid container is dropped is dispersed through portions of the cover 50 in which neither of the first recessed portion 510 and the second recessed portion 520 is formed. This allows the force caused by the impact to be restrained from being transmitted directly to the beams 521 and 511 in the vicinity of the storage element containing area 52, suppressing deformation of the storage element containing area 52.

The width Y2 of each of the first and second recessed portions 510 and 520 along the Y direction is preferably larger than the width Y1 of the storage element containing area 52 along the Y direction. However, when the width Y2 of each of the first and second recessed portions 510 and 520 is excessively large, the first recessed portion 510 and the second recessed portion 520 are enlarged toward the liquid supply portion 11 or the end surface 503. Then, areas around the first recessed portion 510 and the second recessed portion 520 have a reduced strength and may be deformed when the liquid supply portion 11 or the end surface 503 is subjected to impact. Thus, the width Y2 of each of the first and second recessed portions 510 and 520 along the Y direction is preferably within ±50% from the width Y1. However, preferably, end surface side walls 514 and 524 of the first recessed portion 510 and the second recessed portion 520 are each located, in the Y direction, at the same position as that of an inner surface 52*a* of the storage element containing area 52 located closer to the end surface 503, or each of the end surface side walls 514 and 524 is located closer to the end surface 503 than the inner surface 52*a*.

Moreover, an inner side surface 504 of the third recessed portion 534 that is a side surface of the third recessed portion 534 located on an inner side thereof is preferably positioned 2 mm or more outside of the first and second recessed portions 510 and 520 in the Y direction of the cover 50 in order to enhance the strength of the vicinity of the end surface 503 of the cover 50. That is, a distance 11 between the position of the end of the first and second recessed portions 510 and 520 in the Y direction and the inner side surface 504 of the third recessed portion 534 is preferably 2 mm or more

Second Embodiment

Now, a liquid container 1*a* in a second embodiment will be described. In the liquid container 1 in the first embodiment, the first recessed portion 510 and the second recessed portion 520 are formed in the cover 50 to reduce the thickness of the wall enclosing the storage element unit 60. Thus, the wall enclosing the storage element unit 60 may be buckled.

Figure 6:
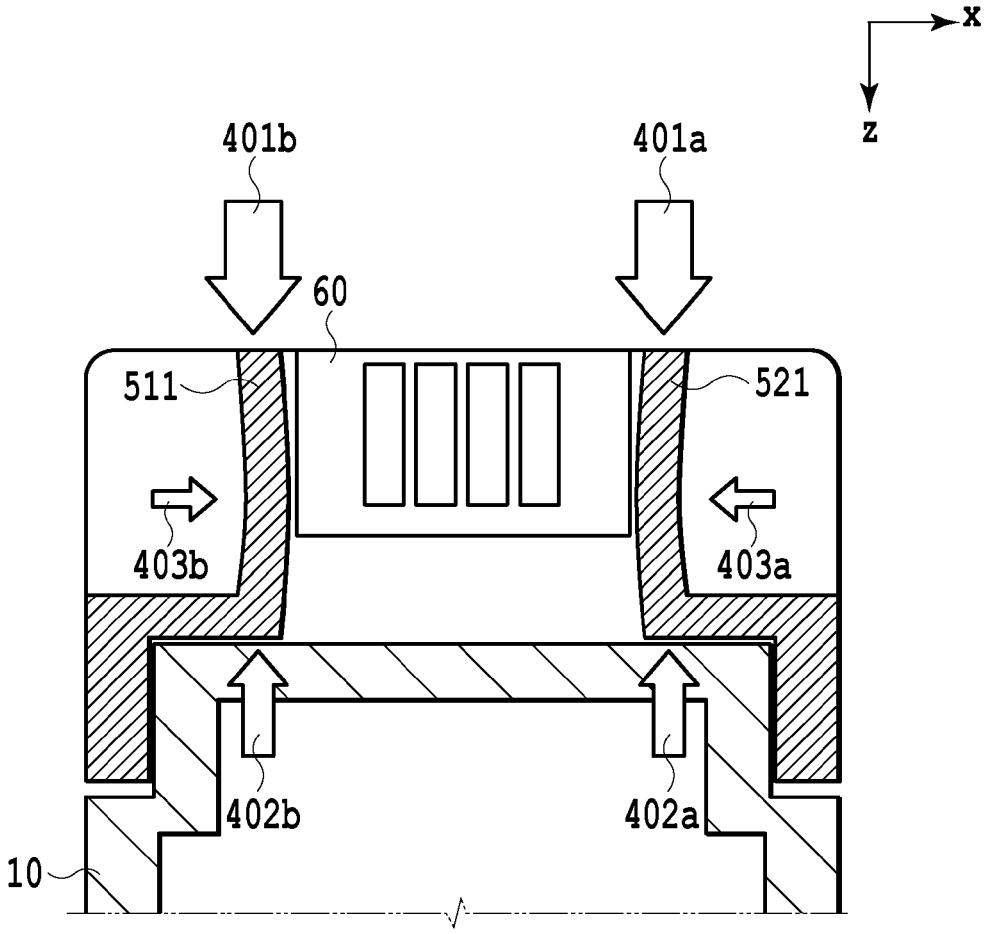
FIG. 6 is a sectional view depicting the state of the liquid container when an external force acts on the liquid container in which no beam is formed inside a recessed portion.

FIG. 6 illustrates that external forces 401*a* and 401*b* from the liquid supply portion 11 of the liquid container 1*a* as depicted by arrows act on the vicinity of the storage element containing area 52 where no beam is formed inside the first recessed portion 510 or the second recessed portion 520. FIG. 6 is a schematic sectional view taken along line Iv-Iv in FIG. 3. As depicted in FIG. 6, upon acting on the cover, the external forces 401*a* and 401*b* are transmitted to the case 10 via the cover. When the external forces 401*a* and 401*b* are transmitted to the case 10, reaction forces 402*a* and 402*b* from the case 10 act on the cover. In this case, the beams 511 and 521 at the positions corresponding to the first recessed portion 510 and the second recessed portion 520, respectively, may be deflected in the directions of arrow 403*a* and 403*b* (or opposite directions). When the beams 511 and 521 are thus buckled, external forces act on the storage element containing area 52, which may thus be deformed.

Figure 7:
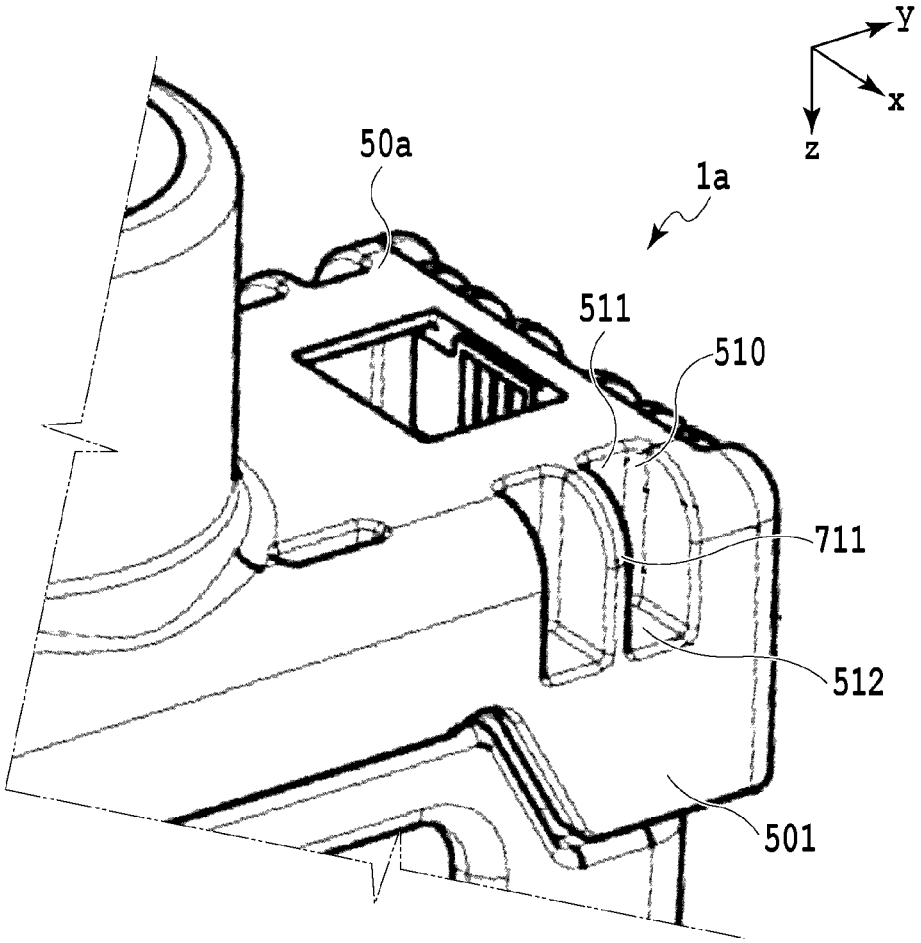
FIG. 7 is a perspective view depicting a part of the liquid container in which a beam is formed inside the recessed portion.
Figure 8:
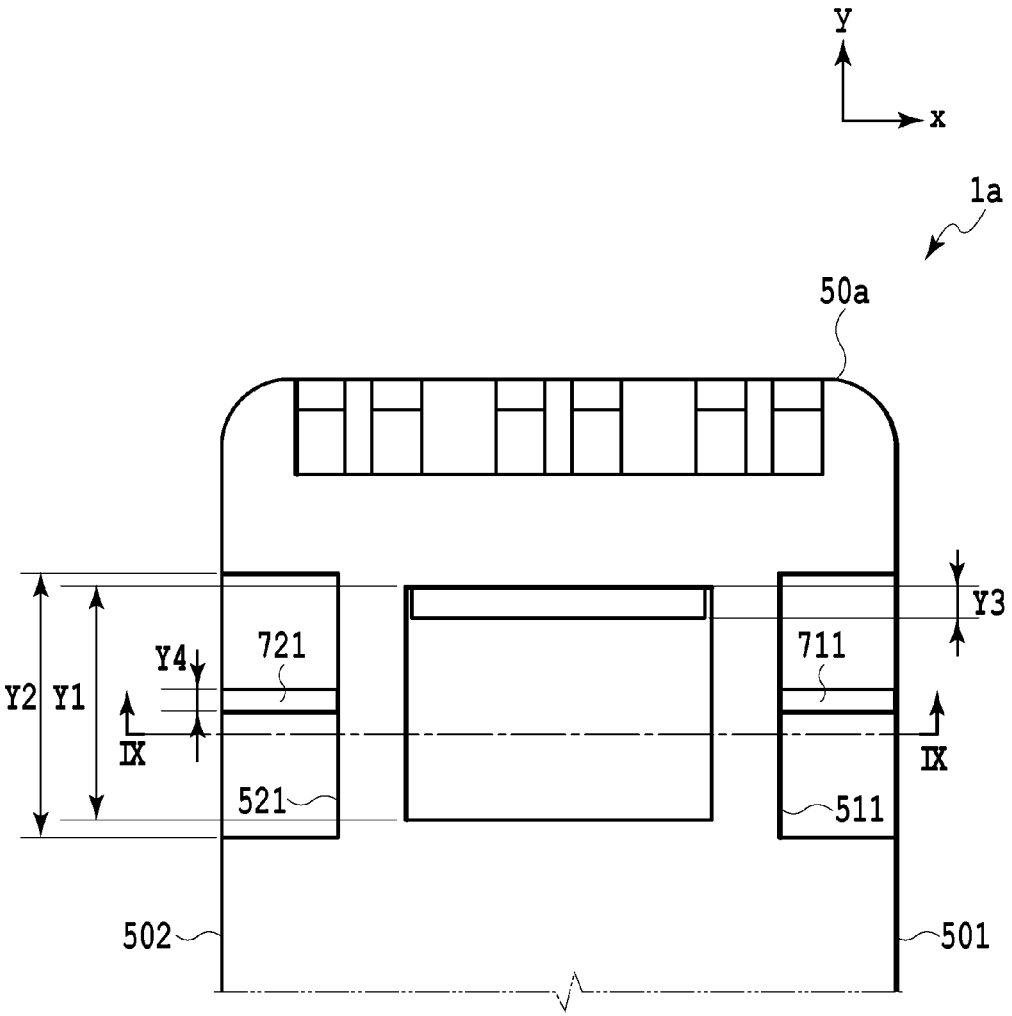
FIG. 8 is a diagram of a part of the liquid container in FIG. 7 as viewed from above.

In this regard, as depicted in FIG. 7, to restrain the beams 511 and 521 from being buckled, beams 711 and 721 are preferably provided in the recessed portions 510 and 520. FIG. 7 depicts a perspective view of a cover 50*a* with the beams 711 and 721 provided inside the first recessed portion 510 and the second recessed portion 520, respectively. FIG. 8 depicts a plan view of a part of a side of the cover 50*a* on which the mechanical ID 53 is formed where the beams 711 and 721 are provided inside the first recessed portion 510 and the second recessed portion 520, respectively.

In the second embodiment, the beams 711 and 721 are formed to extend along the X direction. That is, the beams extend perpendicularly to the boundary between the first surface and the second surface and to the boundary between the first surface and the third surface.

As depicted in FIG. 8, the beams 711 and 721 are formed to have such a length as prevents the beams 711 and 721 from protruding outward with respect to the side surfaces 501 and 502, respectively, of the cover 50*a*. In FIG. 8, the beams 711 and 721 are formed to extend to the same positions as those of the side surfaces 501 and 502, respectively, of the cover 50*a* along the X direction so as to have the same length as that of parts of the side surfaces 501 and 502 of the cover 50*a* that extend along the X direction.

Figure 9:
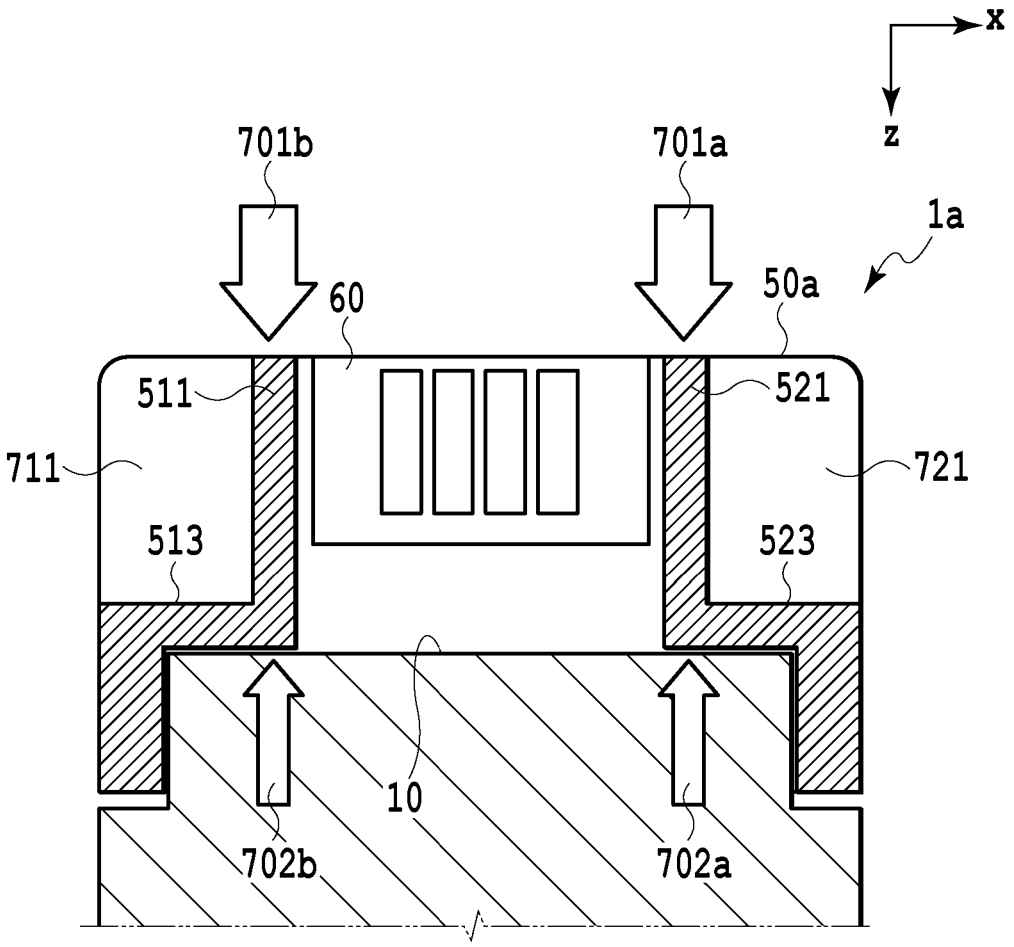
FIG. 9 is a sectional view of the liquid container in FIG. 8 taken along line IX-IX.

FIG. 9 depicts a sectional view of the cover 50*a* illustrating external forces applied to the cover 50*a* along the Z direction. FIG. 9 is a sectional view taken along line IX-IX in FIG. 8. The beams 711 and 721 are formed inside the first recessed portion 510 and the second recessed portion 520, respectively, and thus, the storage element containing area 52 can be prevented from being deformed when external forces 701*a* and 701*b* are applied to the storage element containing area 52 in the Z direction as depicted in FIG. 9.

The effects of the beams 711 and 721 will be described which are produced when the external forces 701*a* and 701*b* act on the storage element containing area 52 in the Z direction and reaction forces from the case 10 act on the storage element containing area 52.

The external forces 701*a* and 701*b* and the reaction forces 702*a* and 702*b* act on the beams 511 and 521, respectively, in a direction in which the beams 511 and 521 are compressed along the Z direction. At this time, since the beams 711 and 721 are formed inside the first recessed portion 510 and the second recessed portion 520, respectively, of the cover 50*a*, the external forces acting on the cover 50*a* are dispersively separated into forces acting on the beams 511 and 521 and forces acting on the beams 711 and 721. Therefore, reduced external forces act on the beams 511 and 521, which can be restrained from being deformed.

The length Y4 of each of the beams 711 and 721 along the Y direction as depicted in FIG. 8 is preferably minimized. A minimized length Y4 of the beams 711 and 721 along the Y direction facilitates deformation of the beams 711 and 721 when the external forces act on the beams 711 and 721. Since the beams 711 and 721 are easily deformed, when the side surfaces 501 and 502 of the cover 50*a* are subjected to impact, the beams 711 and 721 are deformed to absorb the energy of the impact. This mitigates the impact acting on the cover 50*a*, further restraining the storage element containing area 52 from being deformed.

In the above-described second embodiment, the beams 711 and 721 are provided which extend perpendicularly to the boundary between the surface including the storage element containing area 52 (first surface) and the surfaces adjacent to the first surface (second surface and third surface). However, the present invention is not limited to the above-described embodiment. The beams 711 and 721 may be provided to extend parallel to the surface including the storage element containing area 52 (first surface) and the surfaces adjacent to the first surface (second surface and third surface).

Third Embodiment

Now, a liquid container 1*b* in a third embodiment will be described. In the liquid container 1*b* in the third embodiment, beams 712 and 722 are formed at an intermediate position of a recessed portion in the Z direction so as to extend along the X and Y directions.

Figure 10:
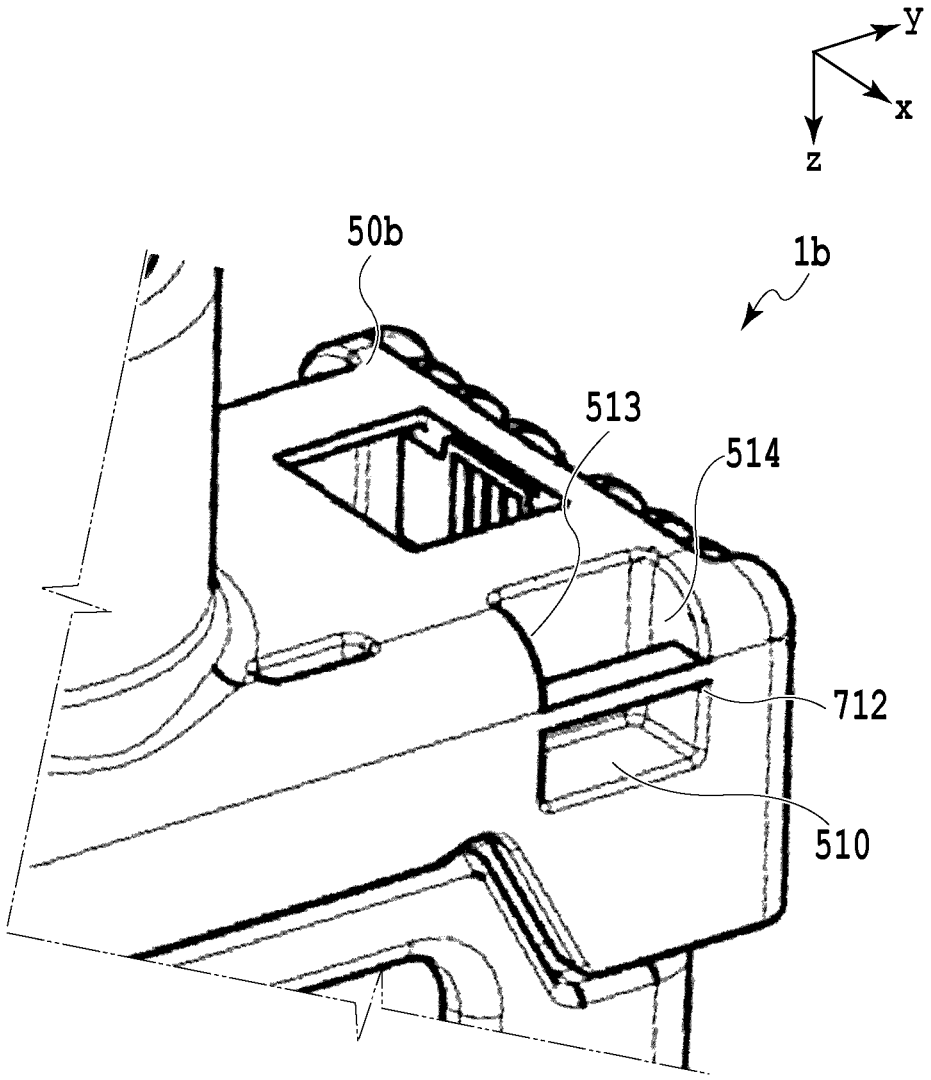
FIG. 10 is a perspective view depicting a part of the liquid container.

FIG. 10 depicts a perspective view of the cover 50*b* of the liquid container 1*b* in the third embodiment. In the cover 50*b* in the third embodiment, the beams 712 and 722 are provided at the intermediate positions of the first recessed portion 510 and the second recessed portion 520, respectively, in the Z direction. This allows the cover 50*b* to be restrained from being deformed.

Figure 11:
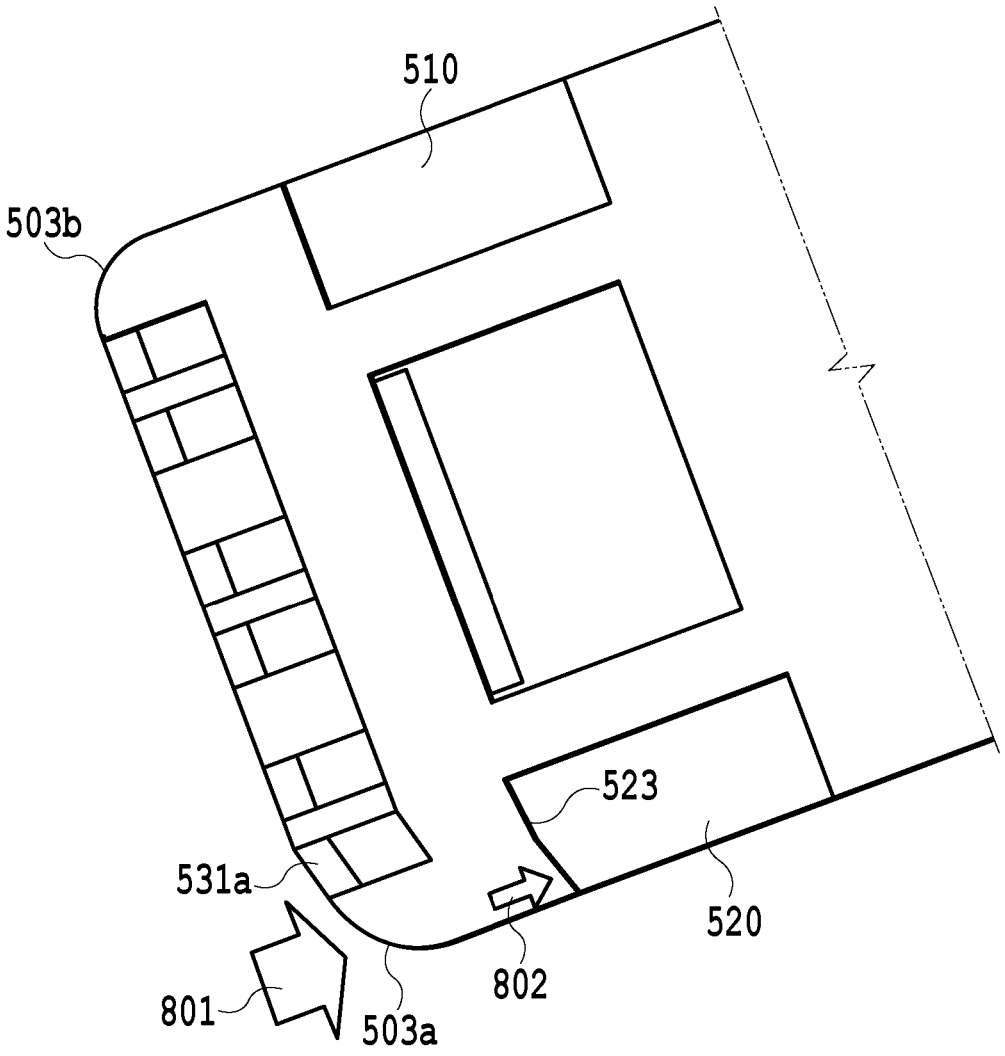
FIG. 11 is a sectional view depicting the state of the liquid container when an external force acts on the liquid container in which no beam is formed inside the recessed portion.

FIG. 11 depicts a plan view of the cover with the beams 712 and 722 not formed in the first recessed portion 510 and the second recessed portion 520, respectively. In the cover depicted in FIG. 11, when an external force 801 acts on the vicinity of a corner 503*a* or 503*b*, a part of the vicinity of the corner 503*a* or 503*b* is pushed by the external force 801 and may be deformed in a direction in which the external force 801 acts. As depicted in FIG. 11, the external force 801 pushes the corner 503*a* to deform the vicinity of the corner 503*a*, thus deforming a side wall 523 of the recessed portion 520. This may displace the position of the beam 531*a* in the above-described mechanical ID 53, which is proximate to the corner 503*a*. When the position of a corresponding part of the mechanical ID 53 on the liquid ejection apparatus side is displaced, the type of the liquid container may fail to be accurately identified. Consequently, the erroneous-installation prevention function of the liquid container may be compromised.

In this regard, in the third embodiment, the beams 712 and 722 are provided in the first recessed portion 510 and the second recessed portion 520, respectively. The beams 712 and 722 are formed inside the first recessed portion 510 and the second recessed portion 520, respectively, at the intermediate positions thereof in the Z direction and are each defined by a plane in the first recessed portion 510 and the second recessed portion 520, respectively. The beams 712 and 722 are formed to partly occupy internal areas of the first recessed portion 510 and the second recessed portion 520 in the X and Y directions. Therefore, the beams 712 and 722 serve as resistance to such deformation caused by compression or pulling as moves side walls of the first recessed portion 510 and the second recessed portion 520, respectively. Therefore, side walls of the portions forming the first recessed portion 510 and the second recessed portion 520 can be restrained from being deformed. In the third embodiment, the beams extend along the Y direction.

Figure 12:
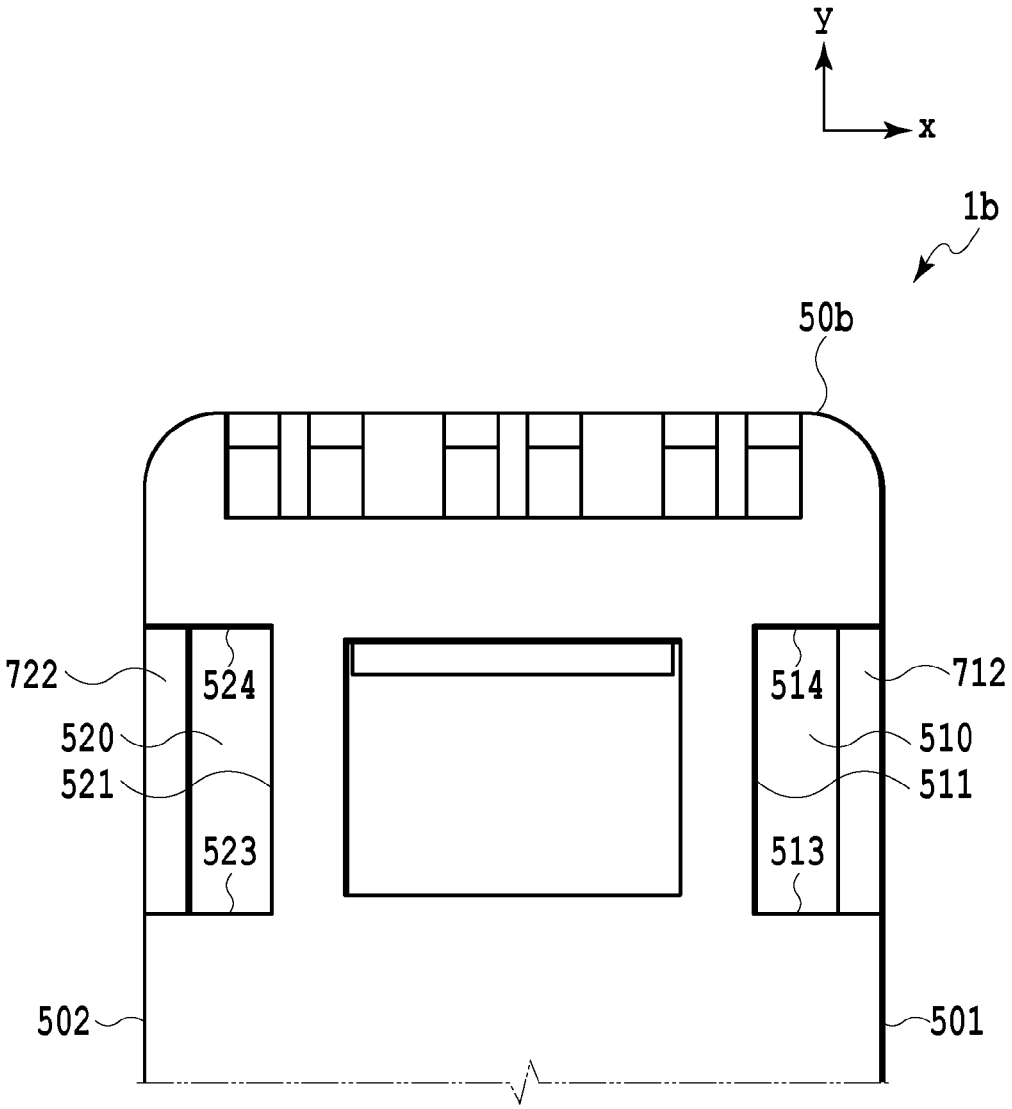
FIG. 12 is a diagram of a part of the liquid container in FIG. 10 as viewed from above.

FIG. 12 depicts a schematic plan view of a part of the vicinity of the storage element containing area 52 of the cover 50*b* as viewed from above in the Z direction. As depicted in FIG. 12, the beams 712 and 722 are arranged away from side surfaces of the beams 511 and 521. In the present embodiment, the beans 711 and 722 are arranged such that the positions of side surfaces of the beams 712 and 722 are the same as the positions of the side surfaces 501 and 502, respectively, of the cover 50*b*. Since the beams 712 and 722 are arranged inside the first recessed portion 510 and the second recessed portion 520, respectively, even when external forces are applied to the beams 712 and 722 through the side surfaces 501 and 502, respectively, of the cover 50*b*, impact can be restrained from being applied directly to the storage element containing area 52.

Figure 13:
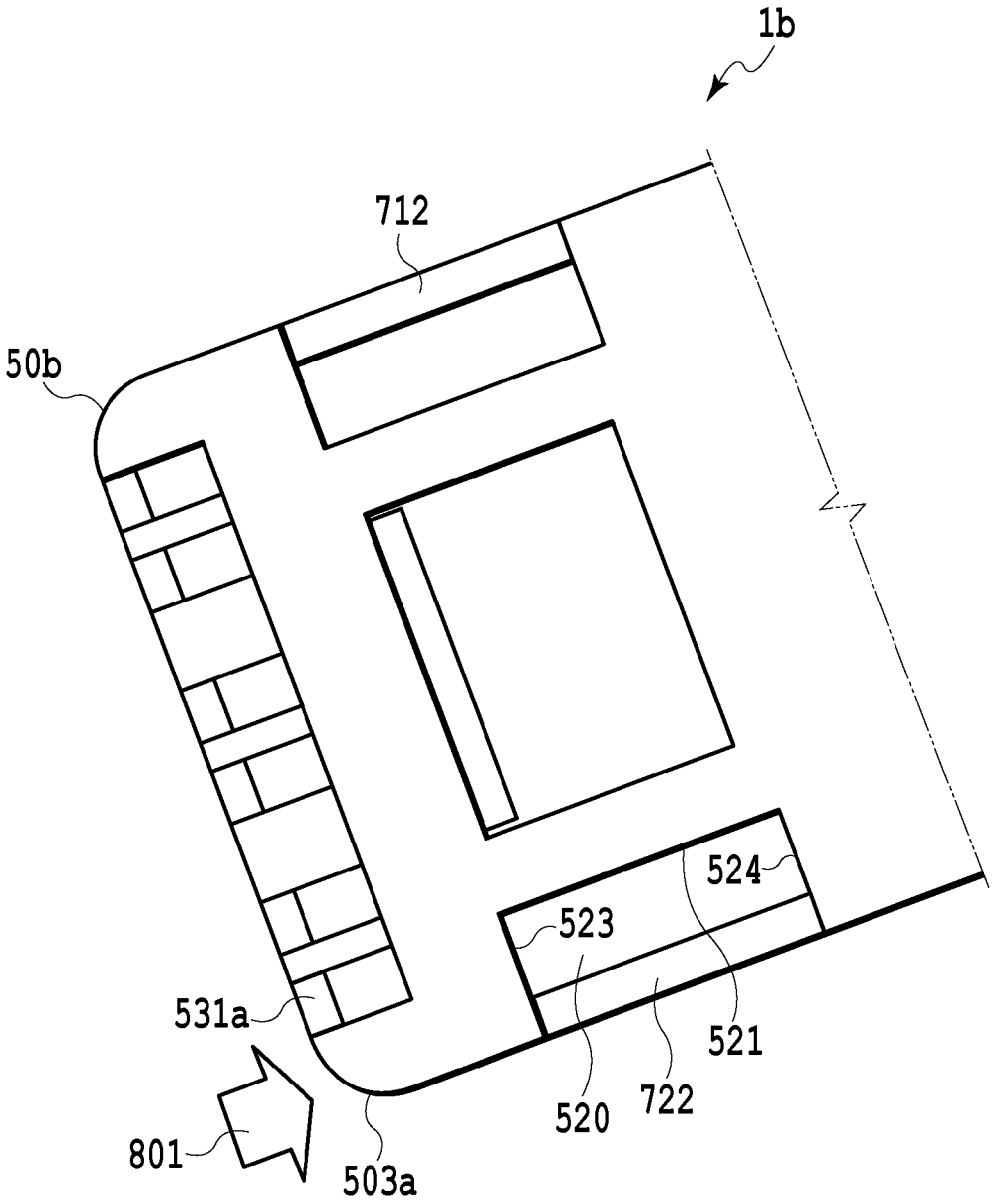
FIG. 13 is a diagram illustrating that an external force acts on a corner of the liquid container.

FIG. 13 depicts a plan view of the state of the vicinity of the storage element containing area 52 when an external force is applied to the corner 503*a* of the cover 50*b* if the beams 712 and 722 are provided inside the first recessed portion 510 and the second recessed portion 520, respectively. As depicted in FIG. 13, even when an external force 801 is applied to the corner 503*a* of the cover 50*b*, since the beam 722 is provided in the second recessed portion 520, the beam 722 supports the side walls 523 and 524 of the second recessed portion 520. Therefore, deformation of the side walls 523 and 524 can be suppressed, and deformation of the corner 503*a* that may result from deformation of the side walls 523 and 524 can be suppressed. Thus, the position of the beam 531*a* of the mechanical ID 53 can be restrained from being displaced, allowing maintenance of the accuracy of the mechanical ID 53, which serves as identification unit for the liquid container. As a result, erroneous installation of the liquid container can be suppressed.

Figure 14A:
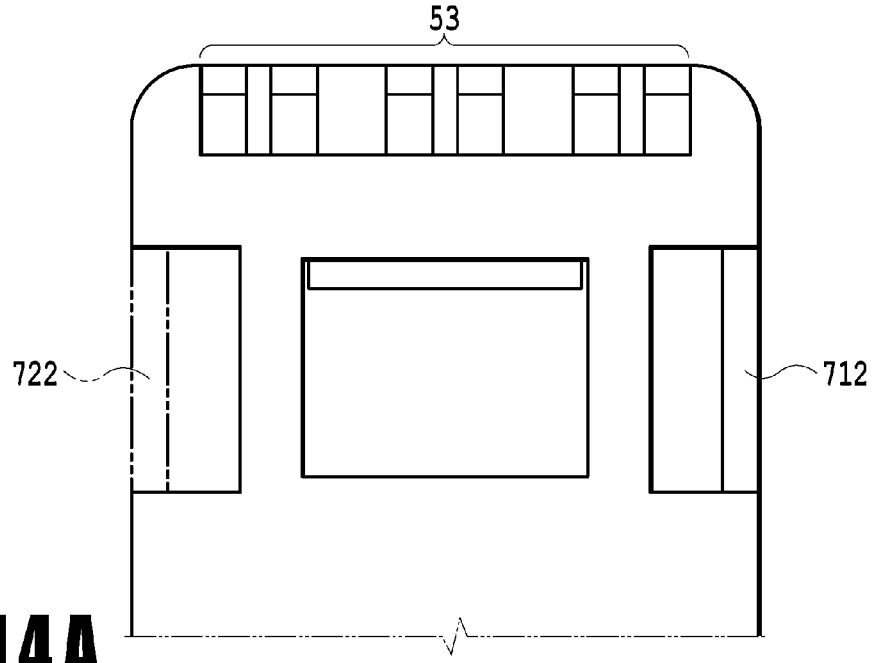
FIG. 14A and FIG. 14B are plan views depicting the liquid container.
Figure 14B:
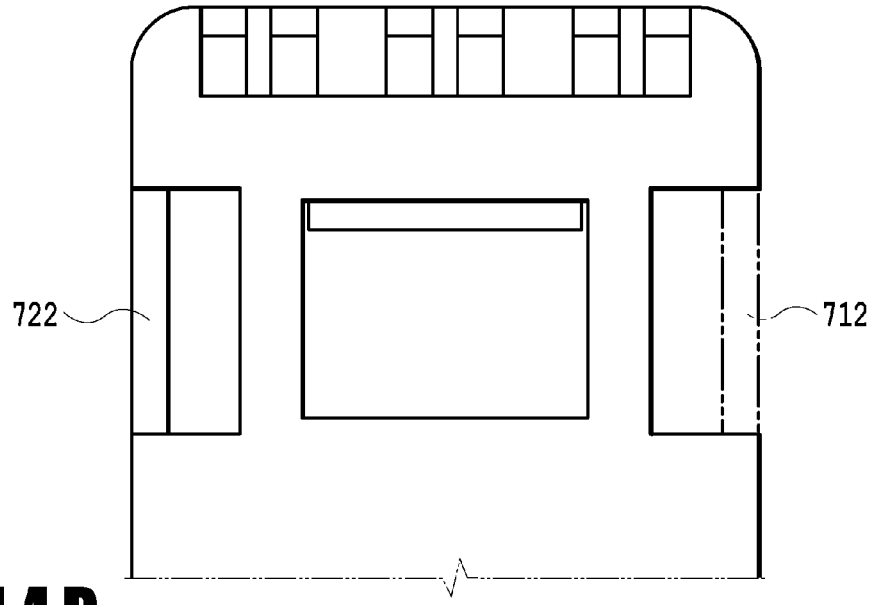

The beams 712 and 722 formed inside the first recessed portion 510 and the second recessed portion 520, respectively, may be configured as a mechanical ID serving as identification unit for identifying the type of the liquid container. FIGS. 14A and 14B depict a schematic plan view of the cover in which the beams 712 and 722 are formed as a mechanical ID.

One of the beams 712 and 722 may be removed, and a corresponding arrangement may be formed in a liquid container installation portion of the main body of the liquid ejection apparatus. That is, a plurality of beams is provided, and some of the beams may be removed according to the type of the liquid container. This enables only the appropriate type of liquid container to be installed at the corresponding position on the main body of the liquid ejection apparatus.

Fourth Embodiment

Now, a liquid container 1*c* in a fourth embodiment will be described. In the second embodiment, beams each extending along a plane in the Z and X directions are formed in the first recessed portion 510 and the second recessed portion 520. In the third embodiment, beams each extending along a plane in the X and Y directions are formed in the first recessed portion 510 and the second recessed portion 520. In the fourth embodiment, both a beam extending along a plane in the Z and X directions and a beam extending along a plane in the X and Y directions are formed in each of the first recessed portion 510 and the second recessed portion 520. That is, the fourth embodiment includes a beam extending perpendicularly to the boundary between the first surface and the second surface or the boundary between the first surface and the third surface and a beam extending parallel to the boundary between the first surface and the second surface or the boundary between the first surface and the third surface.

Figure 15:
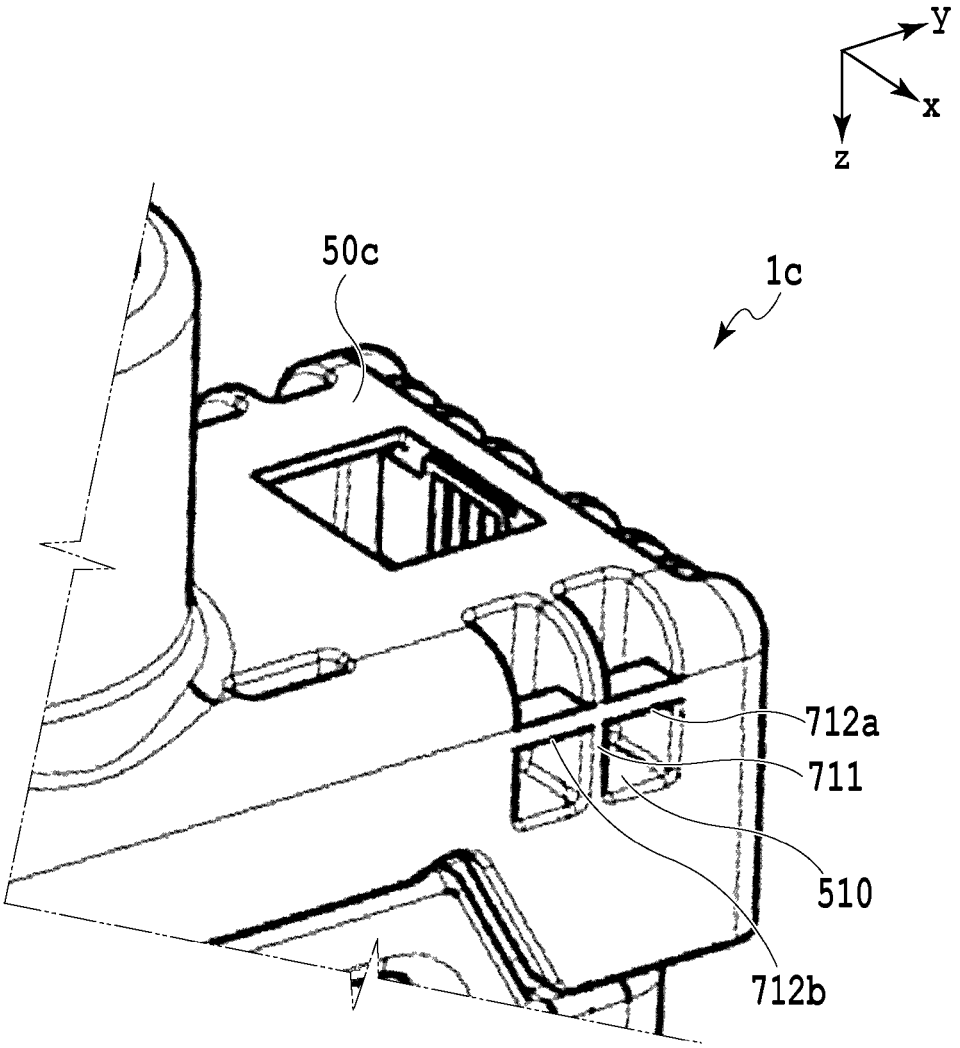
FIG. 15 is a perspective view depicting a part of the liquid container.
Figure 16:
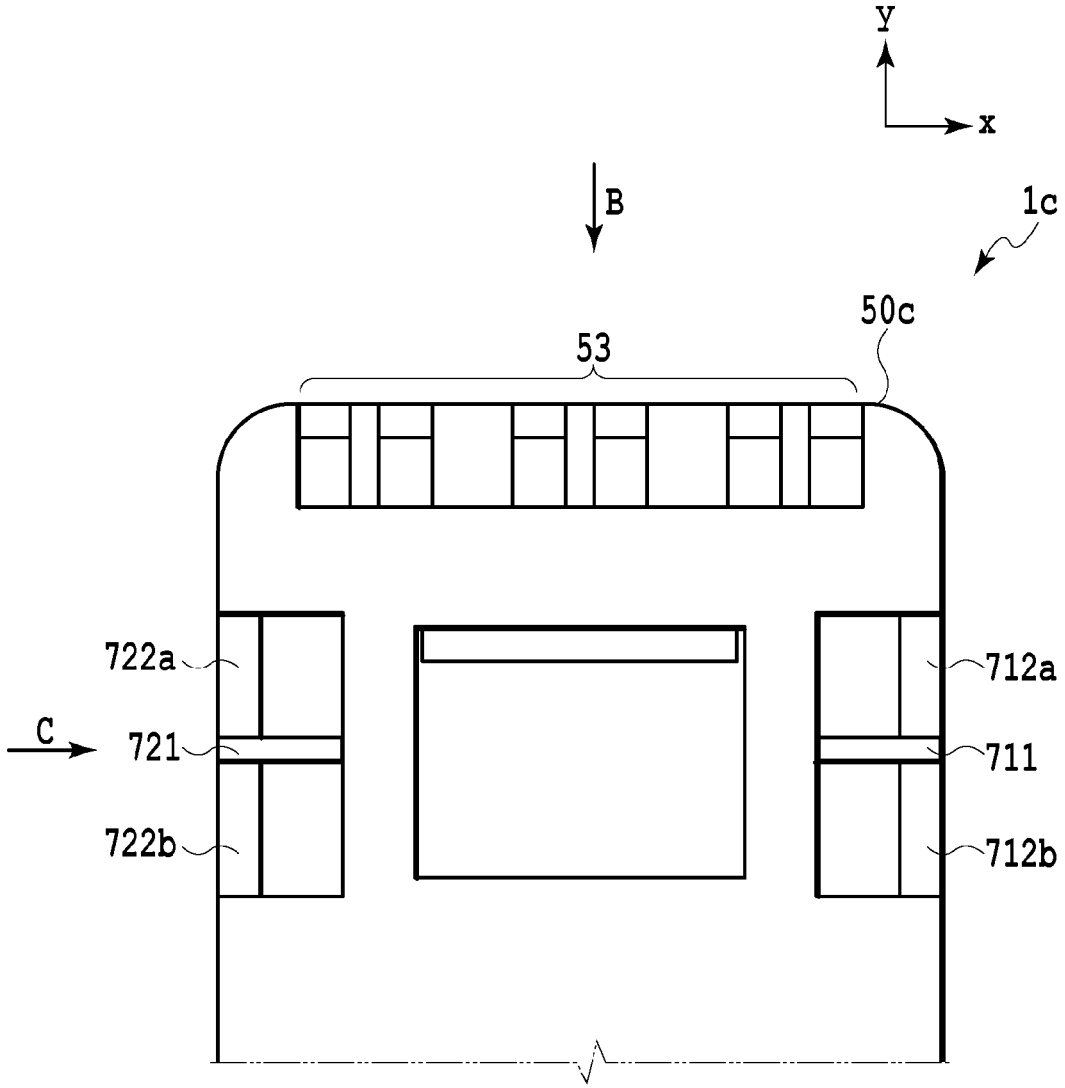
FIG. 16 is a diagram of a part of the liquid container in FIG. 15 as viewed from above.

FIG. 15 depicts a perspective view illustrating a cover 50*c* of the liquid container 1*c* in the fourth embodiment. FIG. 16 depicts a schematic plan view of the cover 50*c* of the liquid ejection apparatus in the fourth embodiment. Since both a beam along a plane in the Z and X directions and a beam along a plane in the X and Y directions are formed inside each of the first recessed portion 510 and the second recessed portion 520, the beams can bear both an external force B along the Y direction and an external force C along the X direction. Therefore, the cover 50*c* of the liquid container 1*c* can be more reliably restrained from being deformed. The storage element unit 60 can also be more reliably restrained from falling off from the cover 50*c*. Specifically, as depicted in FIG. 16, four beams 712*a*, 712*b*, 722*a*, and 722*b* are provided by separating each of the beams 712 and 722 into two portions and arranging each of the beams 711 and 721 at an intermediate position between the resultant portions of the corresponding one of the beams 712 and 722. The four beams 712*a*, 712*b*, 722*a*, and 722*b* can also be used as identification unit for identifying the type of the liquid container. The appropriate type of liquid container can be exclusively installed at the predetermined position by removing any one of the four beams 712*a*, 712*b*, 722*a*, and 722*b* and forming a corresponding arrangement in the liquid container installation portion of the liquid ejection apparatus.

Figure 17:
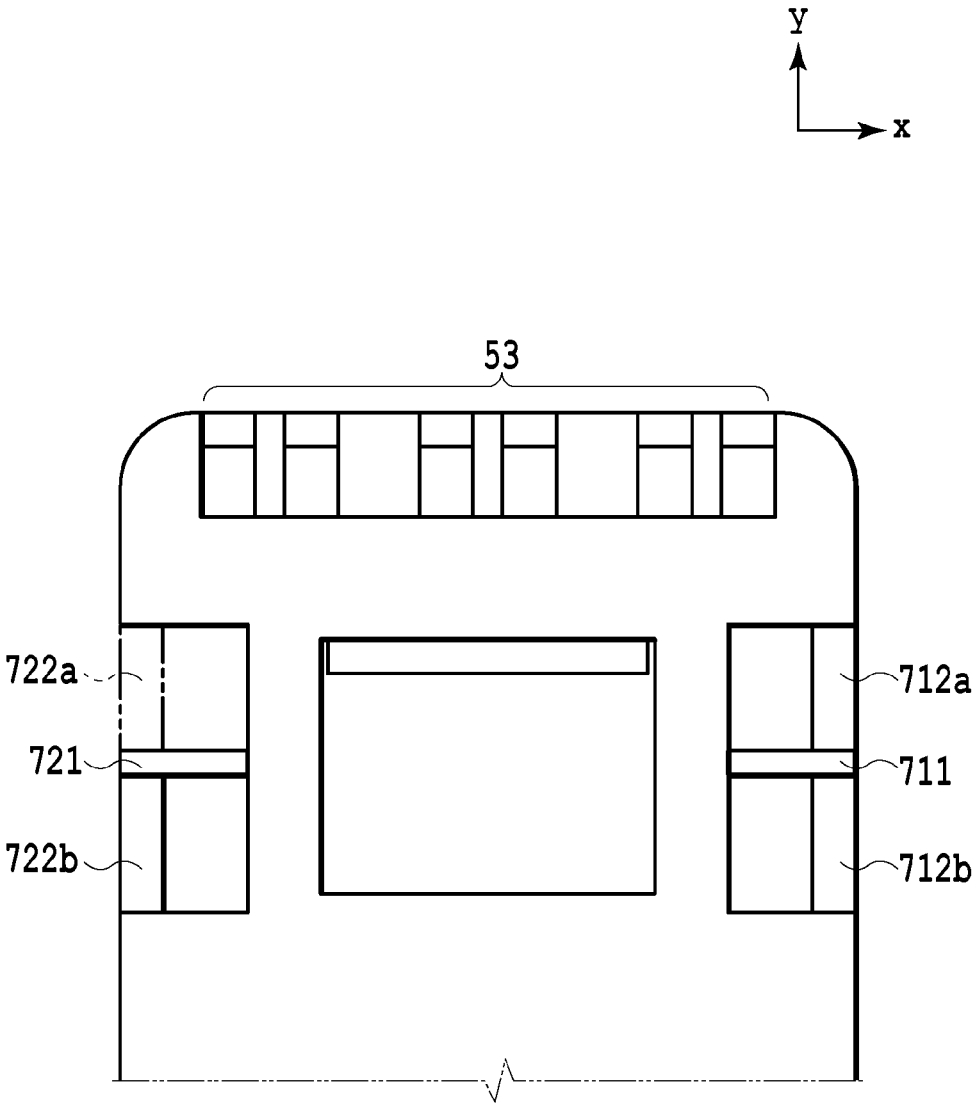
FIG. 17 is a plan view depicting the liquid container.
Figure 18:
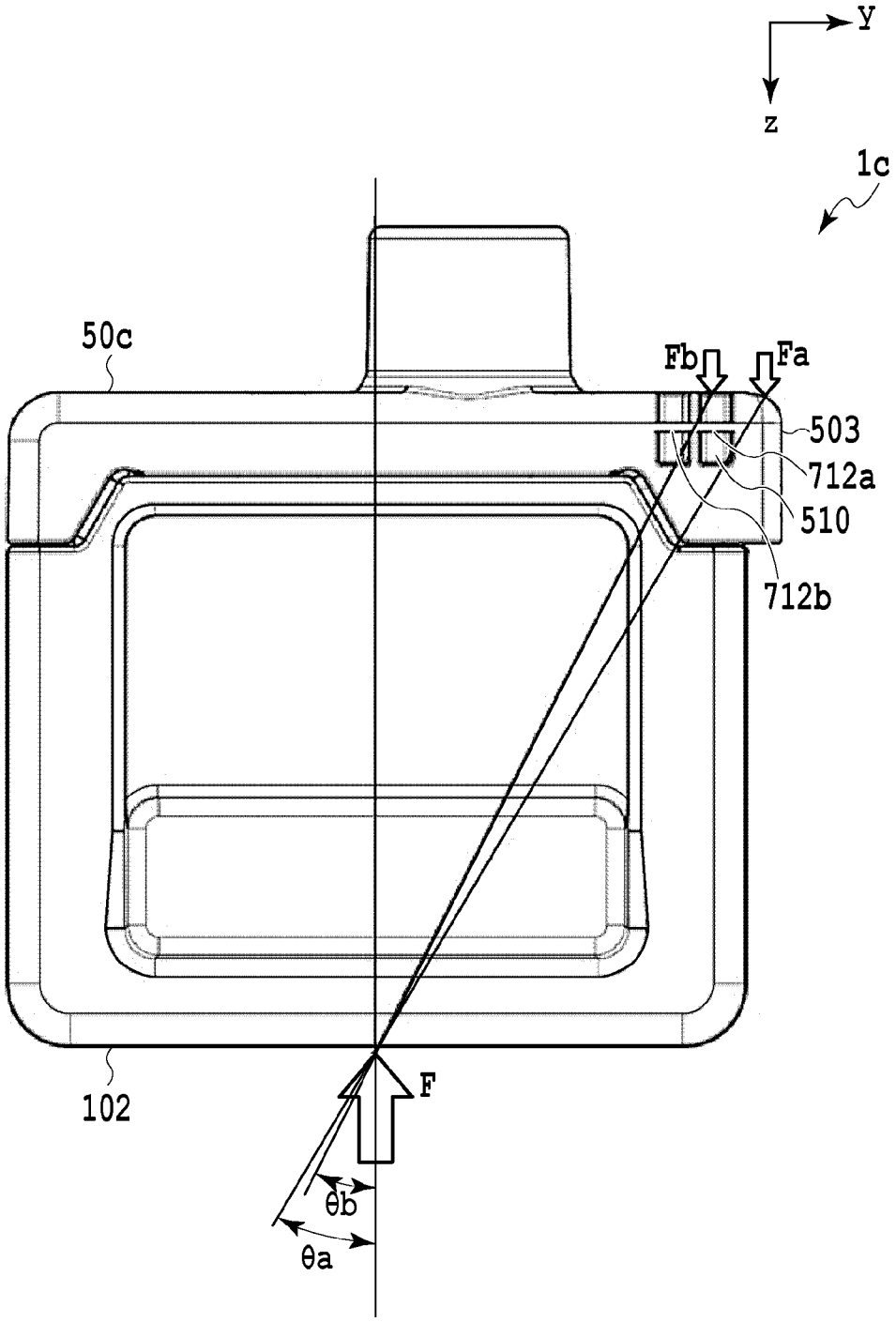
FIG. 18 is a diagram depicting respective forces acting at positions in an end of the liquid container and the recessed portion when an external force acts on the liquid container.

As described above, also in the present embodiment, the four beams 712*a*, 712*b*, 722*a*, and 722*b* can be used as mechanical IDs for identifying the type of the liquid container. FIG. 17 depicts a plan view of the cover in which only one beam 722*a* has been removed from the four beams 712*a*, 712*b*, 722*a*, and 722*b*. An increased number of mechanical IDs as described above enables an increased number of mechanical ID patterns to be provided. Therefore, more types of liquid containers can be identified.

Now, loads imposed on a recessed portion-side mechanical ID portion and an end surface-side mechanical ID portion will be described which are imposed at the time of erroneous installation when the beams inside the recessed portions 510 and 520 are used as mechanical IDs.

When the liquid container 1*c* is installed in the liquid ejection apparatus, if the liquid container 1*c* is erroneously installed at a position different from the correct position, the mechanical ID beams of the liquid container 1*c* interfere with pins on the main body of the liquid ejection apparatus, precluding arrangement of the liquid container 1*c*. When installing the liquid container 1*c*, the user often pushes the vicinity of the center of the top surface 102 of the liquid container 1*c* along the direction in which the liquid container 1*c* is installed in the liquid ejection apparatus. In the case of erroneous installation, when the liquid container is pushed for installation, the mechanical IDs of the liquid container interfere with the pins of the liquid ejection apparatus to generate reaction forces. The resultant reaction forces at the positions of the respective mechanical IDs will be described.

A force applied by the user to install the liquid container is denoted as F. Reference character Fb is used to represent a reaction force in the vicinity of each of the recessed portion 510 and 520 that is exerted in the Z direction at the same position as that of the vicinity of each of the first recessed portion 510 and the second recessed portion 520 in the Z direction. Reference character Fa is used to represent a reaction force in the vicinity of the end surface that is exerted in the Z direction at the same position as that of the vicinity of the end surface 503 in the Z direction. Angles subtended between an applying direction of F and lines with which the points where F, Fa, and Fb act are joined together are denoted as θa and θb. The first recessed portion 510 and the second recessed portion 520 are closer to the center of the liquid container 1 than the end surface 503, and thus, θa>θb. In other words, the force F disperses toward the recessed portion 520 (510) and the end surface 503 to become F cos θa and F cos θb, and based on a relation θa>θb>90°, F cos θb>F cos θa. In other words, a force applied to the vicinity of each of the first recessed portion 510 and the second recessed portion 520, which is closer to the center, is stronger than a force applied to the vicinity of the end surface 503. Therefore, in the erroneous installation state, the reaction force Fb applied to the beams 722*a* and 722*b* and the beams 712*a* and 712*b* provided in the first recessed portion 510 and the second recessed portion 520, respectively, is stronger than the reaction force Fa applied to the beam 531 in the end surface 503. Thus, when the liquid container is erroneously installed, the first recessed portion 510 and the second recessed portion 520 are more likely to be subjected to deformation resulting from interference than in the recessed portions 533*a*, 533*b*, 533*c*, 533*d*, 533*e*, and 533*f* of the end surface 503-side mechanical ID 53.

Figure 19A:
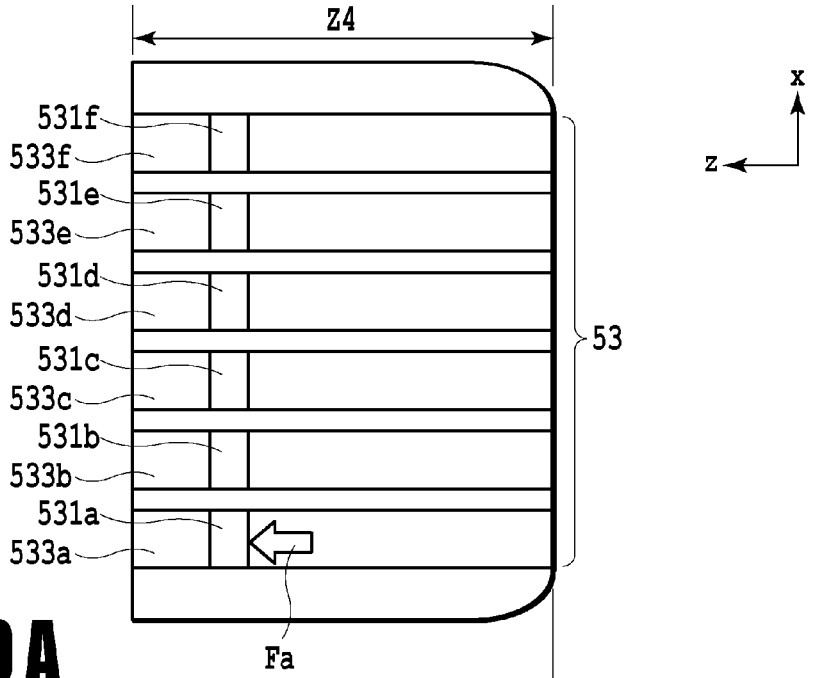
FIG. 19A and FIG. 19B are diagrams depicting forces acting on the beam and a mechanical ID when an external force acts on the liquid container.
Figure 19B:
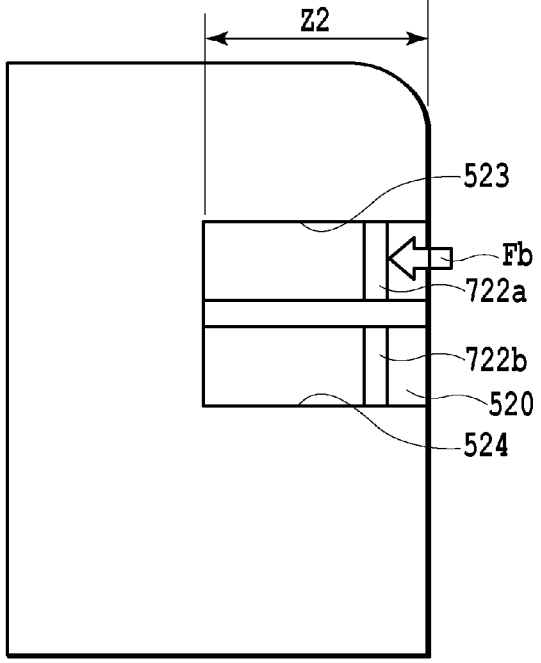

FIG. 19A is a diagram of the portion depicted in FIG. 16 as viewed in a C direction, and FIG. 19B is a diagram of the portion depicted in FIG. 16 as viewed in a B direction. Forming the recessed portion to a small depth allows the corresponding portion to be shaped to be unlikely to be deformed. For the above-described reason, in the present embodiment, the depth Z2 of each of the first recessed portion 510 and the second recessed portion 520 in the Z direction is defined to be smaller than the depth Z4 of the recessed portion 533 in the end surface 503 as depicted in FIGS. 19A and 19B.

In the present embodiment, even when the reaction force Fb, which is stronger than the reaction force Fa applied to the beams 531*a*, 531*b*, 531*c*, 531*d*, 531*e*, and 531*f*, is applied to the beams 722*a* and 722*b* or the beams 712*a* and 712*b*, the vicinity of the first recessed portion 510 or the second recessed portion 520 can be restrained from being deformed because the recessed portions 510 and 520 is formed to a small depth.

Furthermore, when the depth of the storage element containing area 52 in the Z direction is denoted as Z1, the Z dimension of the storage element unit 60 is denoted as Z3, and the depth of each of the first and second recessed portions 510 and 520 in the Z direction is denoted as Z2, a relation Z3<Z2<Z1 is satisfied, as is the case with the first to third embodiments. Consequently, deformation of the storage element unit 60 can be suppressed, and deformation of the first recessed portion 510 and the second recessed portion 520 in the case of erroneous installation can be suppressed.

Fifth Embodiment

Figure 20A:
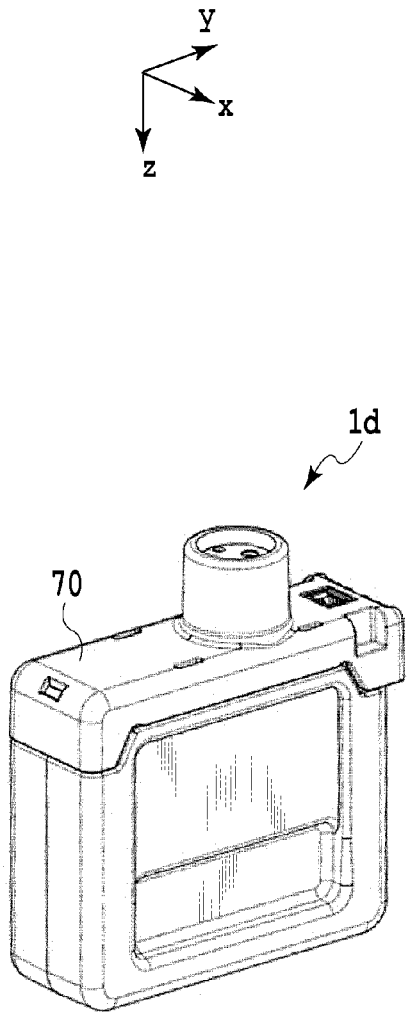
FIG. 20A is a perspective view depicting the liquid container.
Figure 20B:
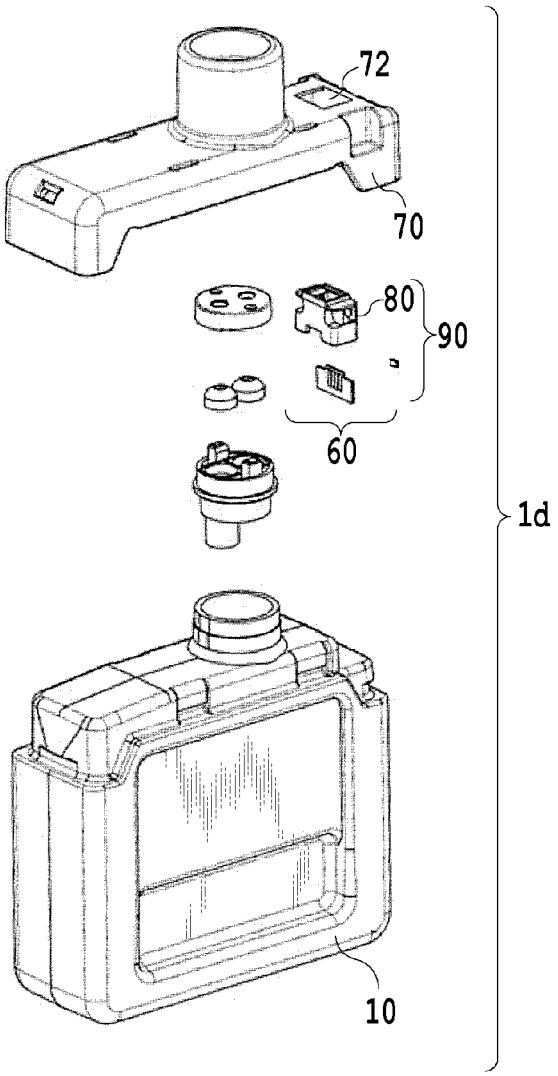
FIG. 20B is an exploded perspective view depicting the configuration of the liquid container that has been disassembled.

Now, a liquid container 1*d* according to a fifth embodiment will be described. FIGS. 20A and 20B depict a perspective view and an exploded perspective view of the liquid container 1*d* according to the fifth embodiment. As depicted in FIGS. 20A and 20B, in the liquid container 1*d*, the storage element unit 60 is assembled to a storage element unit containing structure 80 to form a storage element unit assembly 90. The storage element unit assembly is assembled to the liquid container 1*d* via a cover 70. The cover 70 has a storage element unit assembly containing area 72 in which the storage element unit assembly 90 is contained. A clearance 700 is defined between the storage element unit assembly 90 and the storage element unit assembly containing area 72. With the clearance 700 defined between the storage element unit assembly 90 and the storage element unit assembly containing area 72, the storage element unit assembly 90 is attached to the inside of the storage element unit assembly containing area 72.

Figure 21:
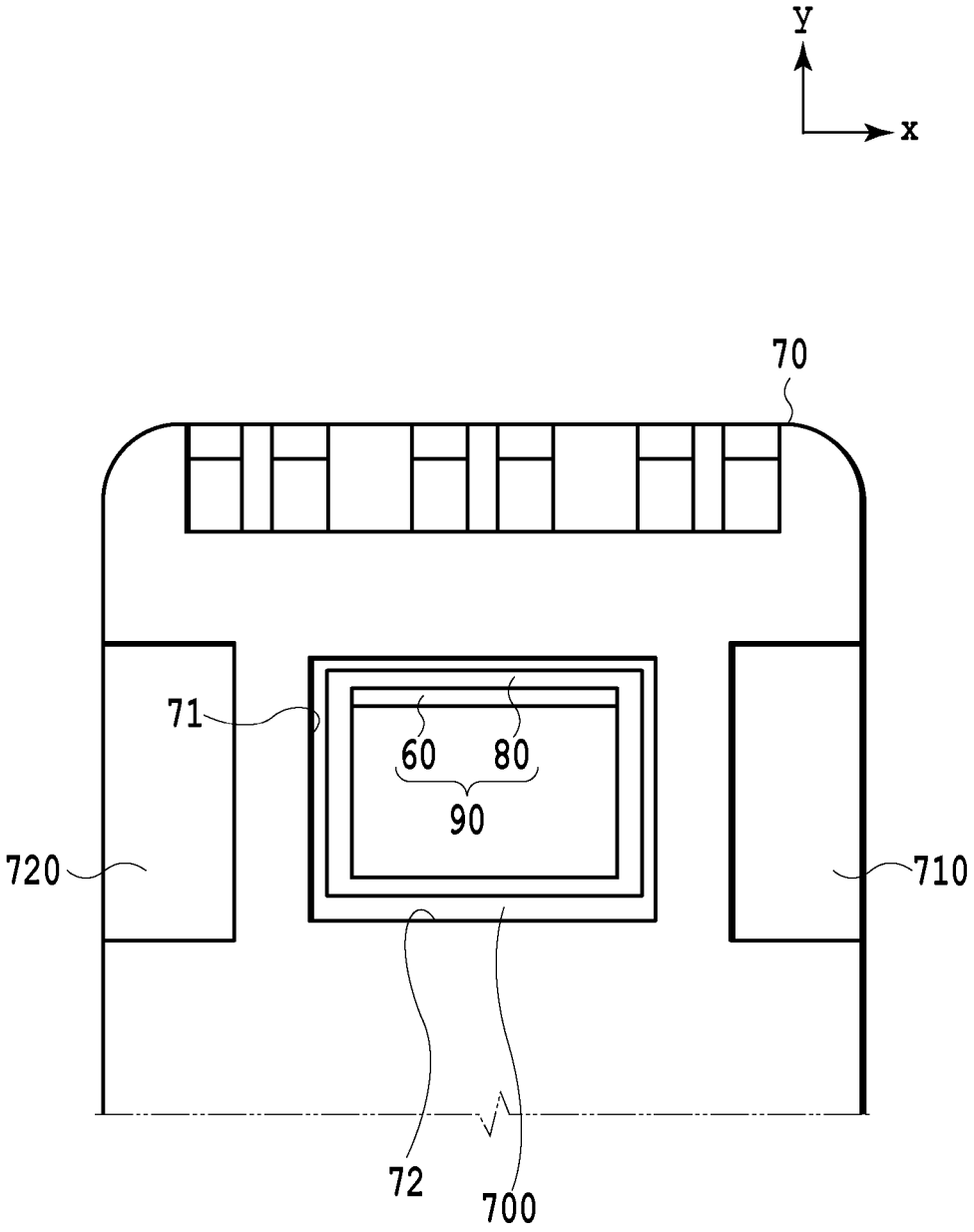
FIG. 21 is a diagram of a part of the liquid container in FIG. 20A as viewed from above.

FIG. 21 depicts a schematic sectional view of the vicinity of the storage element unit assembly containing area as viewed from above in the Z direction. As described above, the clearance 700 spreading in the X and Y directions is defined between a storage element unit assembly containing area 72 of the cover 70 and the storage element unit assembly 90. Consequently, when the liquid container 1*d* is installed in the liquid ejection apparatus, the storage element unit assembly 90 can moved relative to the liquid container 1*d*. Thus, the storage element unit assembly 90 can be moved so as to connect the liquid container 1*d* fixedly installed in the liquid ejection apparatus to a connector of the liquid ejection apparatus. Accordingly, even with the liquid container 1*d* installed in the liquid ejection apparatus, the storage element unit assembly 90 can be moved to the appropriate position for the connector, allowing the position of the storage element unit assembly 90 to be easily adjusted. In this case, the position of the storage element unit assembly 90 can be adjusted by moving the storage element unit assembly 90 within the range of the clearance 700 to the appropriate position for connection to the connector of the liquid ejection apparatus. That is, the storage element can be equalized and is arranged so as to be movable relative to the liquid container. This allows appropriate electric connection to be more reliably established between the connector of the liquid ejection apparatus and the storage element unit assembly 90.

If, for example, when the liquid container 1*d* with the clearance 700 is dropped, impact is exerted on the liquid container 1*d* and causes the storage element unit assembly containing area 72 to be deformed, the clearance 700 is reduced. This may prevent a desired amount of equalization from being obtained. Thus, the cover 70 of the liquid container 1*d* is provided with a first recessed portion 710 and a second recessed portion 720. When the first recessed portion 710 and the second recessed portion 720 are formed near the storage element unit assembly containing area 72, the storage element unit assembly containing area 72 is restrained from being deformed by impact, for example, when the liquid container is dropped. This restrains the impact from being transmitted to the storage element unit assembly containing area 72 to maintain appropriate electric connection between the connector of the liquid ejection apparatus and the storage element unit assembly 90.

Also in the liquid ejection apparatus in the fifth embodiment, beams may be provided inside the first recessed portion 710 and the second recessed portion 720 as is the case with the second to fourth embodiments.

Figure 22:
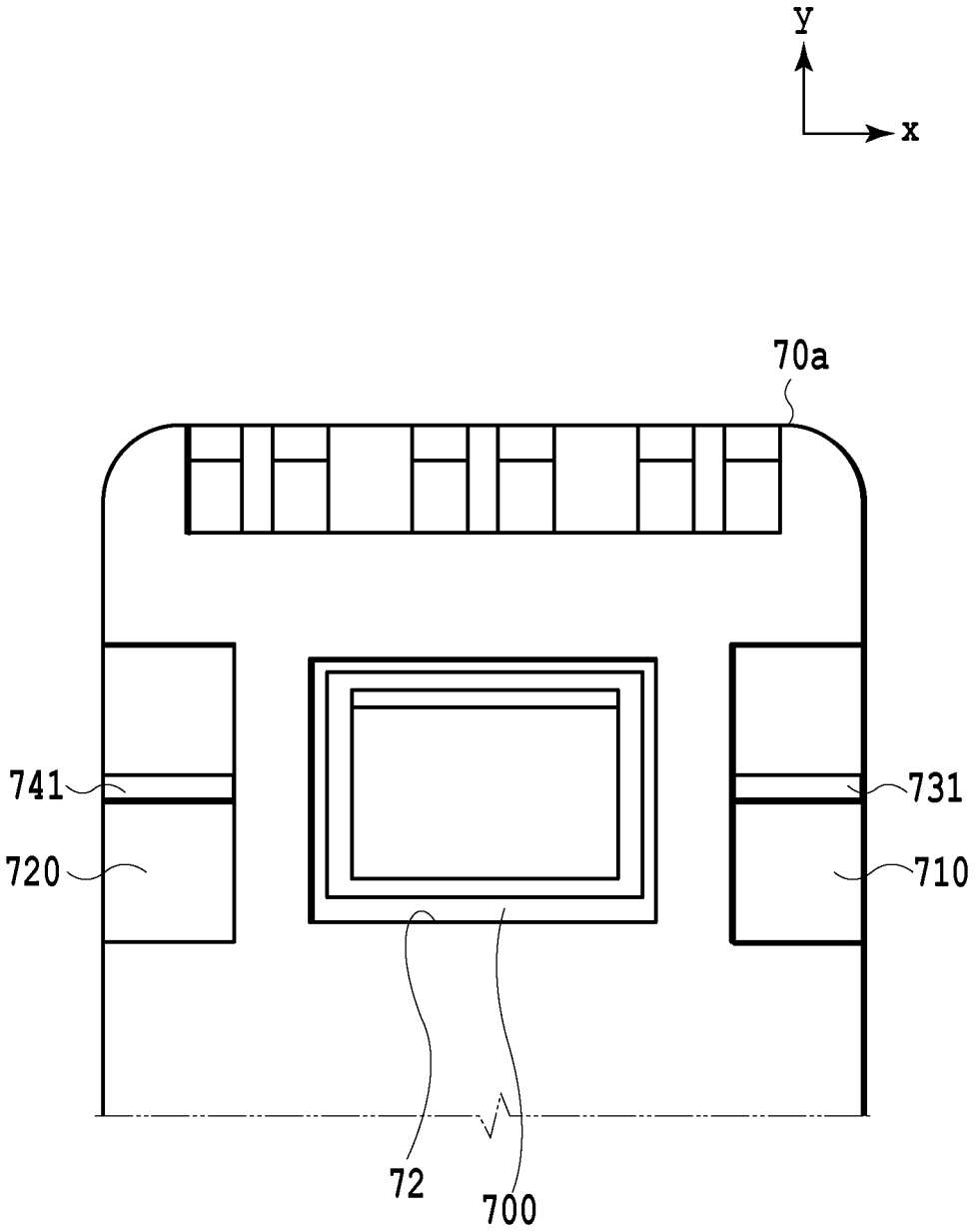
FIG. 22 is a diagram of a part of the liquid container as viewed from above.

FIG. 22 depicts a sectional view of a cover 70*a* in which beams 731 and 741 are provided inside the first recessed portion 710 and the second recessed portion 720, respectively. The beams 731 and 741 formed along the X direction are provided in the first recessed portion 710 and the second recessed portion 720, respectively. Consequently, portions around the first recessed portion 710 and the second recessed portion 720 are supported by the beams 731 and 741, respectively, and thus have an increased strength along the X direction. Thus, even when an external force along the X direction acts on the cover 70*a* in the vicinity of the first recessed portion 710 or the second recessed portion 720, the cover 70*a* is restrained from being deformed.

Figure 23:
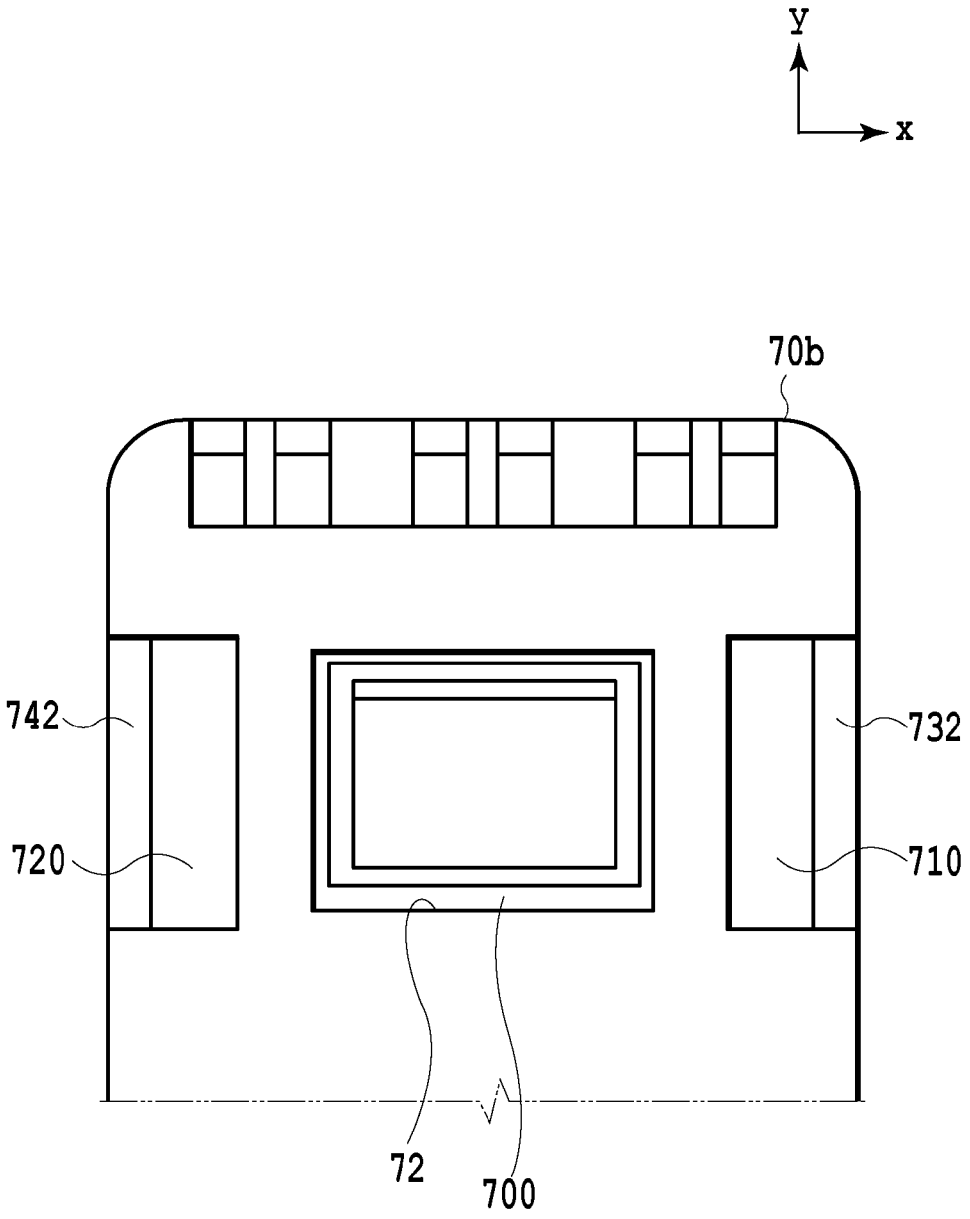
FIG. 23 is a diagram of a part of the liquid container as viewed from above.

A beam formed along the Y direction may be provided in each of the first recessed portion 710 and the second recessed portion 720. FIG. 23 depicts a sectional view of a cover 70*b* in which beams 732 and 742 formed along the Y direction are provided.

The beams 732 and 742 formed along the Y direction are provided in the first recessed portion 710 and the second recessed portion 720, respectively. Consequently, portions around the first recessed portion 710 and the second recessed portion 720 are supported by the beams 732 and 742, respectively, and thus have an increased strength along the Y direction. Thus, even when an external force along the Y direction acts on the cover 70*b* in the vicinity of the first recessed portion 710 or the second recessed portion 720, the cover 70*b* is restrained from being deformed. Therefore, appropriate electric connection is maintained between the connector of the liquid ejection apparatus and the storage element unit assembly 90.

Figure 24:
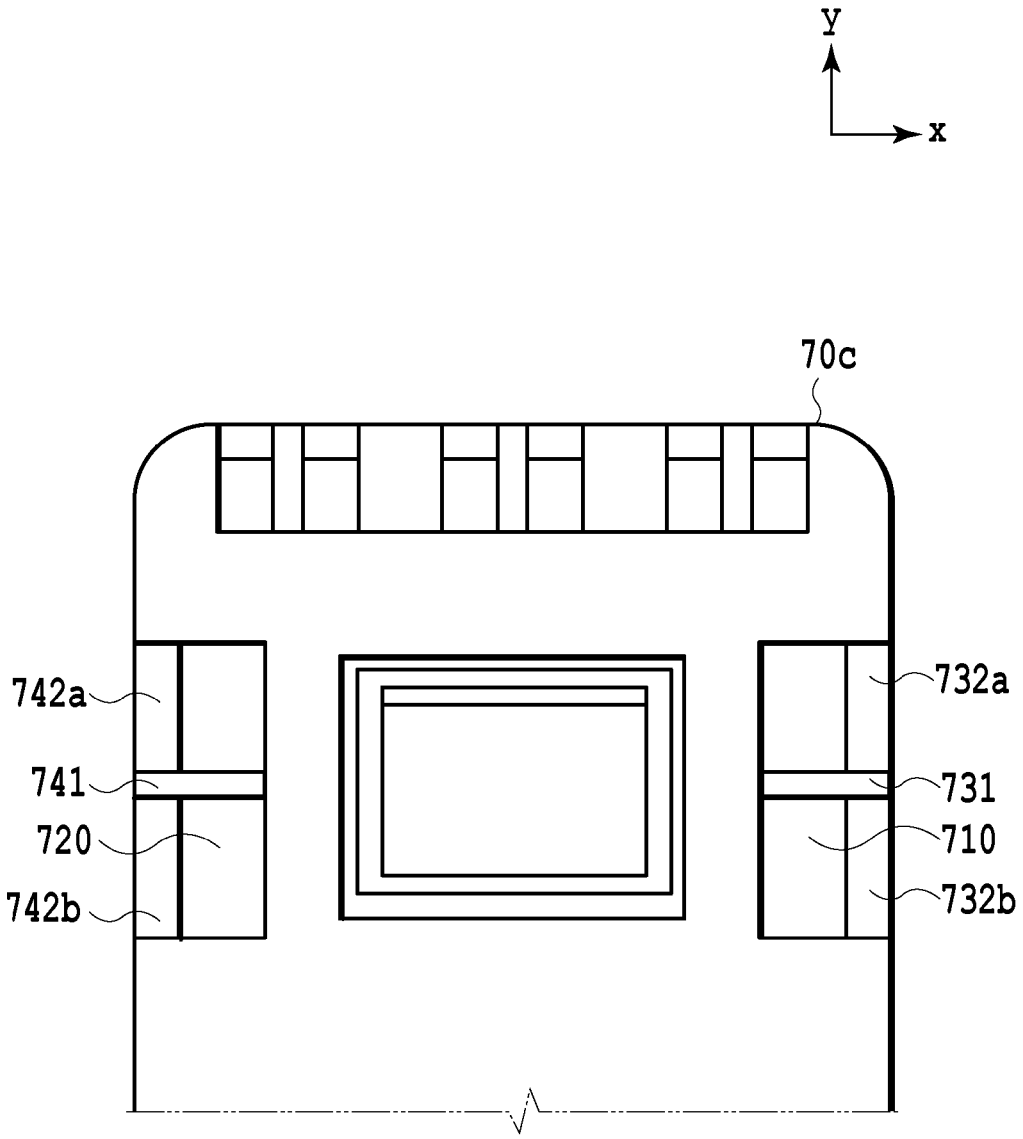
FIG. 24 is a diagram of a part of the liquid container as viewed from above.

A beam formed along the X direction and a beam formed along the Y direction may be provided inside each of the first recessed portion 710 and the second recessed portion 720. FIG. 24 depicts a sectional view of a cover 70*c* in which the beams 731 and 741 formed along the X direction and the beams 732 and 742 formed along the Y direction are provided.

As depicted in FIG. 24, the beams 741 and 731 formed along the X direction and beams 742*a* and 742*b* and beams 732*a* and 732*b* each formed along the Y direction are provided inside the first recessed portion 710 and the second recessed portion 720, respectively. This increases the strength of the cover 70*c* in the X direction and the Y direction. Therefore, the cover 70*c* is more reliably restrained from being deformed, allowing appropriate electric connection to be more reliably established between the connector of the liquid ejection apparatus and the storage element unit assembly 90.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-194313, filed Sep. 30, 2015, which is hereby incorporated by reference herein in its entirety.

What is claimed is:

1. A liquid container enabled to contain a liquid therein; wherein an outer wall of the liquid container has a first surface, a second surface, a third surface, and a fourth surface, the second surface and the third surface are adjacent to the first surface, the second surface and the third surface face each other, and the fourth surface is adjacent to the first surface, the second surface, and the third surface, a boundary between the first surface and the second surface and a boundary between the first surface and the third surface are longer than a boundary between the first surface and the fourth surface, the first surface has a space in which a storage element storing information on the liquid container is contained, the first surface and the second surface have a first recessed portion that crosses the boundary between the first surface and the second surface, and the first surface and the third surface have a second recessed portion that crosses the boundary between the first surface and the third surface, and the first recessed portion and the second recessed portion face each other across the space, wherein when a direction parallel to the second surface viewed from the first surface side is denoted as Y direction, the width of the first recessed portion in the Y direction is within ±50% of the width of the space in the Y direction, wherein the liquid container includes a case containing a liquid and a cover covering at least a part of the case, and the first recessed portion and the second recessed portion are formed in an outer wall of the cover.

2. The liquid container according to claim 1, which is installed in a liquid ejection apparatus ejecting the liquid and which has a supply port through which the liquid contained in the liquid container is supplied to the liquid ejection apparatus.

3. The liquid container according to claim 2, wherein the supply port is located on the first surface.

4. The liquid container according to claim 3, wherein the first surface and the fourth surface have a third recessed portion crossing a boundary between the first surface and the fourth surface.

5. The liquid container according to claim 1, wherein a beam is provided inside the first recessed portion.

6. The liquid container according to claim 5, wherein the beam extends perpendicularly to the boundary between the first surface and the second surface from the bottom of the first recessed portion.

7. The liquid container according to claim 5, wherein the beam extends parallel to the boundary between the first surface and the second surface from a sidewall of the first recessed portion to the other side wall of the first recessed portion.

8. The liquid container according to claim 5, wherein the beam is partly removed according to a type of the liquid container.

9. The liquid container according to claim 4, wherein the third recessed portion has a protrusion extending from the bottom of the third recessed portion and parallel to the second surface.

* * * * *